US008640266B2

(12) United States Patent
Best et al.

(10) Patent No.: US 8,640,266 B2
(45) Date of Patent: Feb. 4, 2014

(54) MAGNETIC SECURING DEVICE ASSEMBLY AND METHOD FOR SECURING A GARMENT WHILE NURSING

(76) Inventors: Elizabeth Best, Atlanta, GA (US); Clareanne Best, White Oak, PA (US)

( * ) Notice: Subject to any disclaimer, the term of this patent is extended or adjusted under 35 U.S.C. 154(b) by 381 days.

(21) Appl. No.: 12/798,106

(22) Filed: Mar. 30, 2010

(65) Prior Publication Data

US 2011/0239702 A1 Oct. 6, 2011

(51) Int. Cl.
*A44C 15/00* (2006.01)
*A41F 19/00* (2006.01)

(52) U.S. Cl.
USPC ..... 2/321; 2/104; 63/1.18; 63/900

(58) Field of Classification Search
USPC ..... 2/104, 300, 301, 311, 312, 321, 336, 2/338, 340, 52, 46, 309, 244, 269; 24/303, 7, 3.1, 15, 3.2, 66.1, 3.4, 3.13, 24/298, 299, 302; 63/3, 3.1, 1.11, 3.2, 63/900, 1.18, 4.1
See application file for complete search history.

(56) References Cited

U.S. PATENT DOCUMENTS

| | | | | | |
|---|---|---|---|---|---|
| 1,491,578 | A | * | 4/1924 | Ballou et al. | 2/326 |
| 2,461,201 | A | * | 2/1949 | Ellis | 2/311 |
| 2,623,256 | A | * | 12/1952 | Feibelman | 24/303 |
| 2,637,887 | A | * | 5/1953 | Goodman et al. | 24/303 |
| 2,714,269 | A | * | 8/1955 | Charles | 59/80 |
| 3,129,477 | A | * | 4/1964 | Mizuno | 24/303 |
| 3,220,018 | A | * | 11/1965 | Johnson | 2/310 |
| 4,231,137 | A | * | 11/1980 | Fujimoto | 24/303 |
| D296,997 | S | * | 8/1988 | Dobson | D11/6 |
| 5,682,653 | A | * | 11/1997 | Berglof et al. | 24/303 |
| 5,806,346 | A | * | 9/1998 | Schlinger et al. | 63/40 |
| 6,640,398 | B2 | * | 11/2003 | Hoffman | 24/303 |
| 6,681,405 | B2 | * | 1/2004 | Yachimec et al. | 2/104 |
| 6,836,899 | B1 | * | 1/2005 | Glasmire | 2/52 |
| 6,962,063 | B1 | * | 11/2005 | Pearl | 63/3.2 |
| 7,793,518 | B1 | * | 9/2010 | Holleman | 63/33 |
| 2003/0005558 | A1 | * | 1/2003 | Wong | 24/303 |
| 2004/0020240 | A1 | * | 2/2004 | Brancato | 63/3 |
| 2004/0200236 | A1 | * | 10/2004 | Emberson et al. | 63/23 |
| 2006/0174649 | A1 | * | 8/2006 | Azrielant | 63/14.1 |
| 2006/0272076 | A1 | * | 12/2006 | Schroeder | 2/336 |
| 2008/0104742 | A1 | * | 5/2008 | Alperin et al. | 2/321 |
| 2009/0235435 | A1 | * | 9/2009 | Baker | 2/323 |
| 2010/0083699 | A1 | * | 4/2010 | Conigliaro | 63/1.18 |
| 2010/0101274 | A1 | * | 4/2010 | Worth | 63/40 |
| 2010/0154104 | A1 | * | 6/2010 | Winning | 2/323 |
| 2012/0047630 | A1 | * | 3/2012 | Gare | 2/244 |

FOREIGN PATENT DOCUMENTS

JP 11-103915 A * 4/1999

* cited by examiner

*Primary Examiner* — Amy Vanatta
(74) *Attorney, Agent, or Firm* — Robert Z. Evora, Esq.

(57) ABSTRACT

Magnetic securing device assemblies and methods for securing a garment away from a breast. The magnetic securing device assembly includes a first and second magnetic element. At least one of the first and second magnetic elements is attached to a cord which is used to carry the magnetic securing device assembly as an ornamental piece of jewelry. In use, the magnetic securing device assembly is positioned around a lifted garment of the wearer. The first magnetic element is separated from the second magnetic element attached to the cord. The first magnetic element is then positioned on an opposite side of the garment, and in alignment with the position of the second magnetic element. The first magnetic element and the second magnetic element are then magnetically fastened to each other so that the garment is securely held away from the breast.

11 Claims, 18 Drawing Sheets

FIG. 32
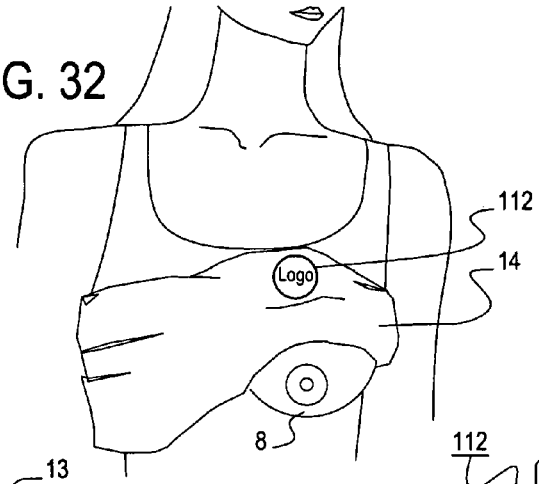
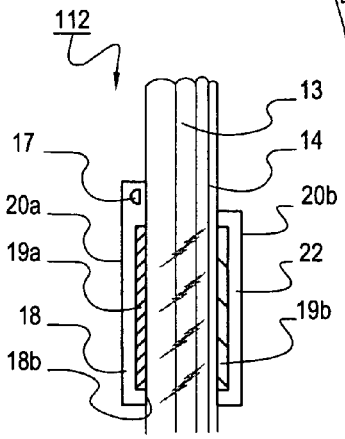
FIG. 33
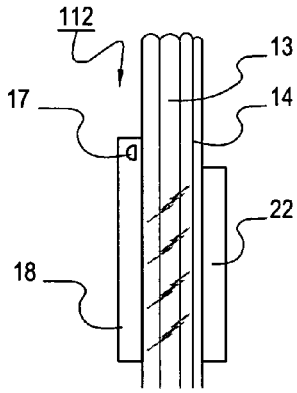
FIG. 34
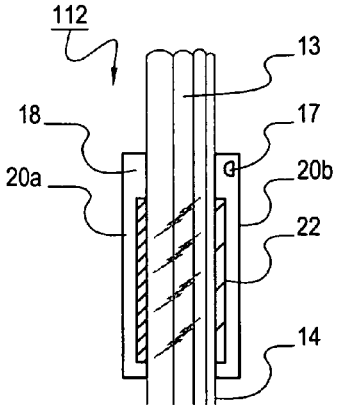
FIG. 35
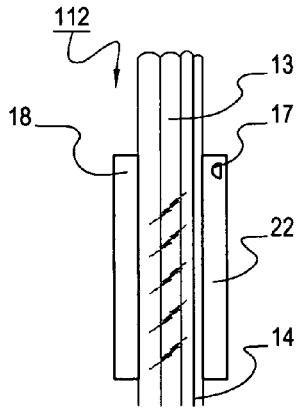
FIG. 36

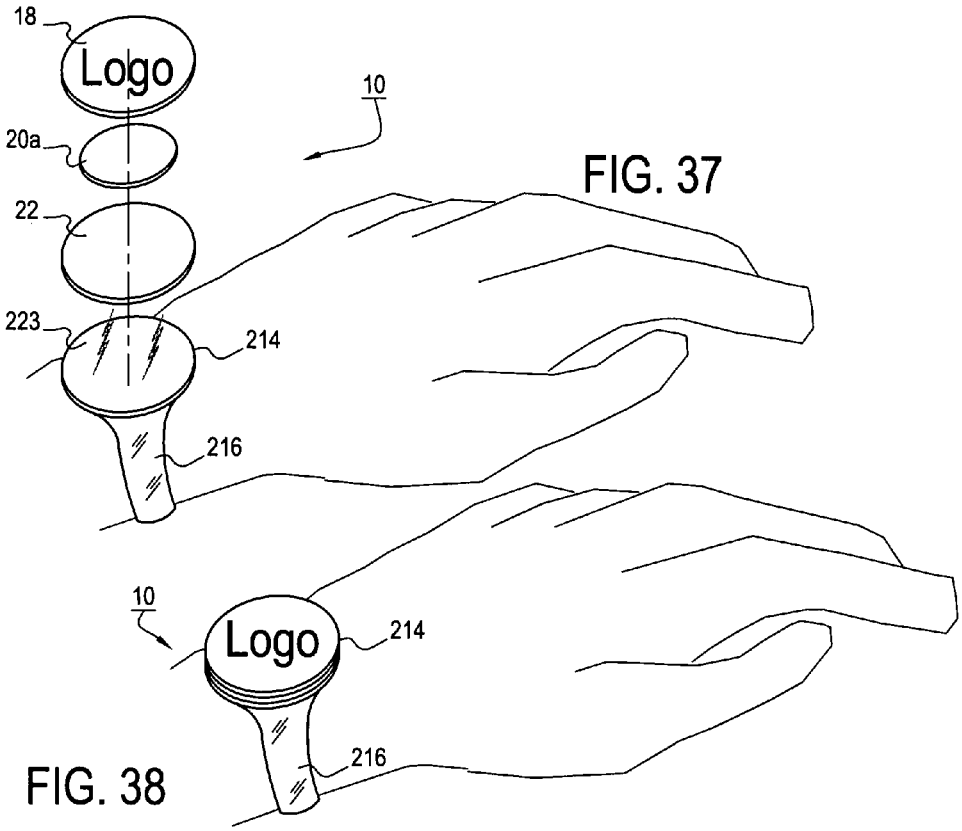
FIG. 37
FIG. 38
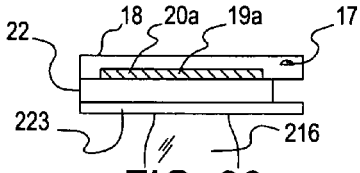
FIG. 39
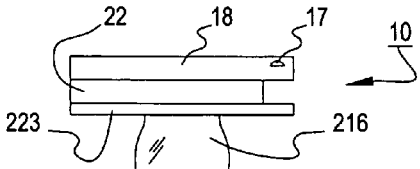
FIG. 40
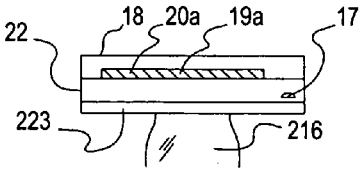
FIG. 41
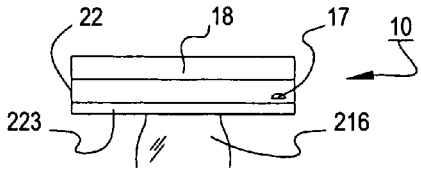
FIG. 42

FIG. 55
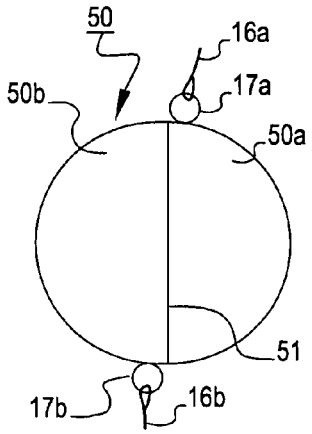
FIG. 56
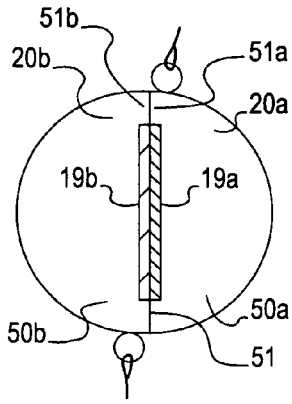
FIG. 57
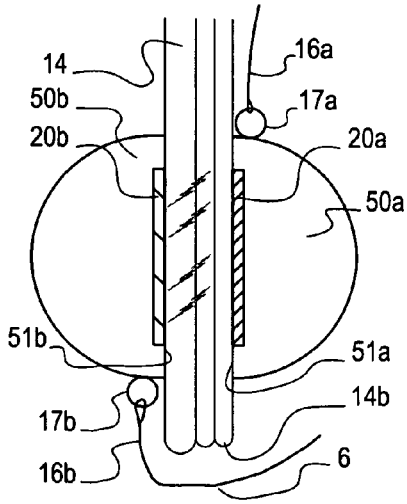
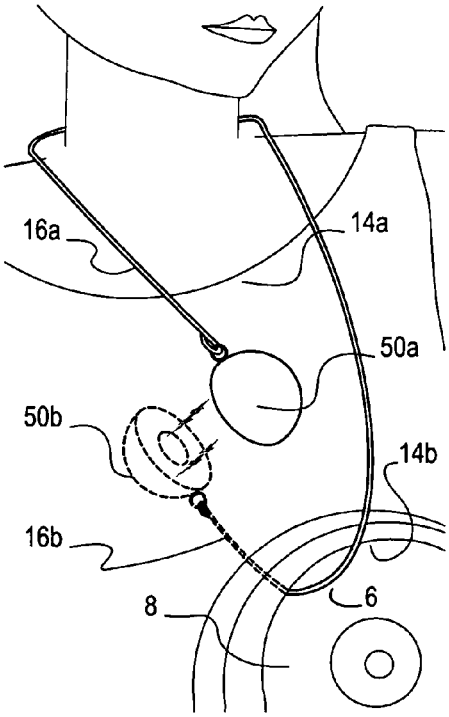
FIG. 58
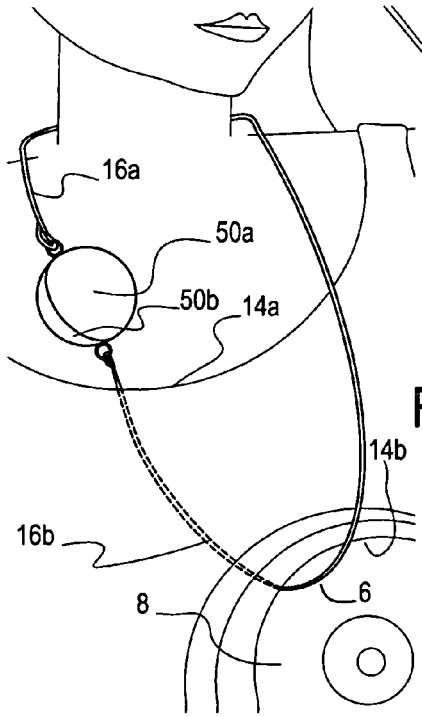
FIG. 59
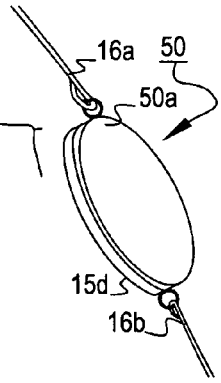
FIG. 60

FIG. 61
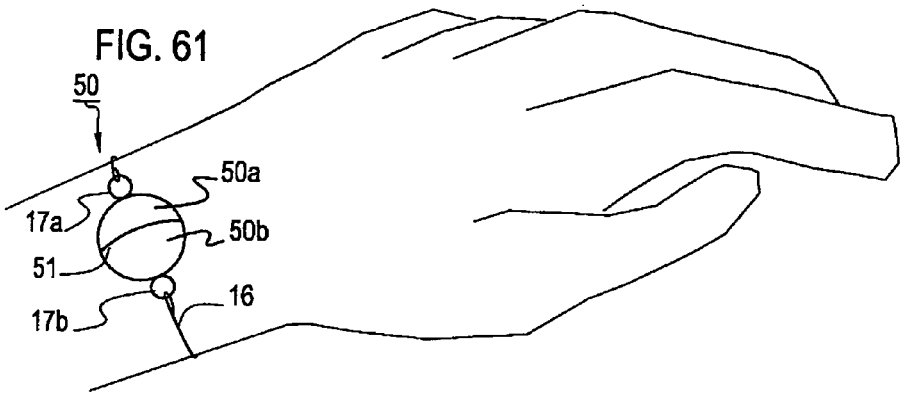
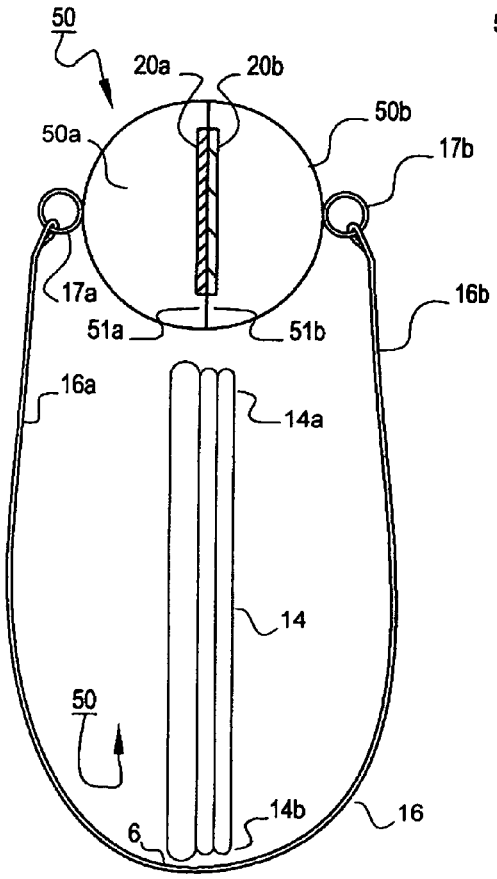
FIG. 62
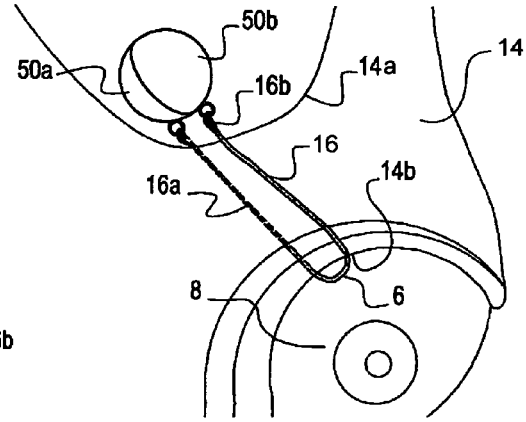
FIG. 63
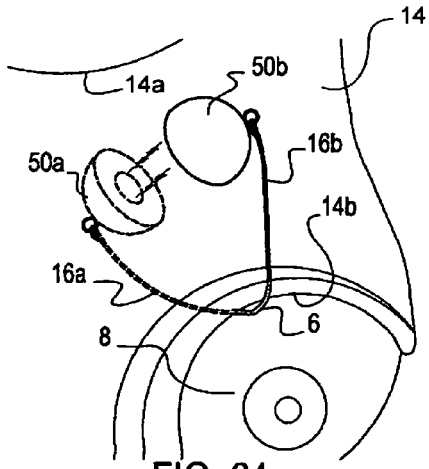
FIG. 64

MAGNETIC SECURING DEVICE ASSEMBLY AND METHOD FOR SECURING A GARMENT WHILE NURSING

BACKGROUND OF THE INVENTION

1. Field of the Invention

The present invention relates in general to a garment securing device, and particularly, to a magnetic securing device assembly adapted to hold a garment in place over the breasts while a mother nurses an infant in an efficient and convenient manner.

2. Background Art

Historically, nursing an infant was somewhat awkward and challenging for a woman depending upon her motivation, experience, support system—including, environment and constitution, both temperamentally and physically for her and for her infant. For breast feeding to be effective for a motivated mother, various components are necessary, such as for example, a supportive environment from the hospital to the workplace, the infants' effective ability to "latch-on" and to suckle, and the comfort of skin-to-skin contact experienced by the mother and infant.

With respect to an individual mother's goals, the World Health Organization (WHO), and supported by the Center for Disease Control (i), recommends sustained and exclusive (of other nutritional supplements, i.e., formulas and the like) use of breast milk as the sole source of a child's nutrition for as long as possible. The Surgeon General's goal in 2008 was 75 percent of all infants born in the USA breast fed at birth, and 50 percent at six months, and 25 percent at twelve months. Nationwide, as per a 2008 survey by the CDC and the National Immunization Survey, 35 percent of infants breast fed at 3 months were breast fed exclusively and just 12 percent of the 43 percent, breast fed overall, at 6 months.

In more detail, the WHO, the CDC, and Uniceff have all recommended breast milk as the exclusive source of nutrition through the first six months of life, at the minimum. The existence and production of breast milk, as well as the quantity or supply available, is dependent upon how often the mother nurses each day, and/or expresses milk through some other means, usually by pumping her breasts.

Statistics available through "2009 Breast Feeding Report CardUSA," and as profiled in "Healthy People 2010," and the "CDC and National Immunization Survey" track the percentage of mothers, by state, who breast feed through the first year of life. From these statistics, it is easy to deduce that sustained lactation is difficult to attain as nursing mothers return to their jobs earlier and earlier. Today, in our society, the working mother is returning back to work in as early as 6 to 8 weeks, as opposed to 3 to 6 months which would be more ideal for breast feeding an infant.

According to the CDC Immunization Survey 2003 to 2006, only 36 percent of women nationwide breast fed exclusively through 3 months post birth, decreasing to 10 percent through the first 6 months of life. These figures are well below goals defined by multiple health organizations, suggesting, breast feeding has significant challenges. Likewise, the Bureau of Labor Statistics records showed in 2005, one-quarter of all women in the labor force had children under the age of 3 years. Various other well known reports identified over 50 percent of those women, with a child (or children) under the age of 3 years, further identified that the child (or children) was under the age of one year old.

It still remains to be determined, what number of those women with child(ren) under the age of one year were still lactating. Twenty-seven percent of those mothers with children under the age of one year further had three or more children under the age of 18 years old in 2005. It is well known that regardless of planning, the commitment to provide breast milk is a difficult goal to achieve. As a consequence of our fast paced society, the vast majority or working mothers are forced to go back to work at the end of their short maternity leave period. Consequently, the returning mother is assuredly fatigued. Her work responsibilities and her home responsibilities compete for her energy and focus.

Factors key to sustained breast feeding are the quantity of breast milk made available and the accessibility thereof. That is, a mother must nurse and/or pump frequently to produce increasing volumes of milk, as well as to maintain her supply. Good nutrition, adequate hydration and rest also add to her challenges, creating a daunting task for mothers in our rigorous society.

A plethora of other challenges are poised with respect to breast feeding, such as handling of the infant and her breast simultaneously where one hand is used to nurse from one breast, whereas the other hand/arm are used to support her infant's body. With one hand she must shift her over garment to expose her breast (i.e., the nipple area at minimal), while holding back her clothing from the nursing area so as not to distract her infant or limit her view of the suckling infant. Ideally, it would be useful to be able to lift the fabric up and away from the "latch-on" site so that the hand not being used to support her child's body is free to sooth and watch over the infant's safe latch on. Unfortunately, it is difficult to keep breast tissue away from obstructing the infant's nostrils, and its breathing are frequently blocked during the nursing process. These issues cause disruption to the "latch-on" process by the infant, which frequently leads to the loss of precious breast milk during the initial "let down" (rapid flow) interval of nursing. Unfortunately, clothing contamination by the breast milk (such as soiling) is also prevalent. As a result, the mother's concentration, focus and relaxation are severely handicapped.

Numerous creative solutions have been employed to facilitate the mother's choice to breast feed, from providing upper garments with access panel openings, special snaps and/or button on the apparel, employing draping poncho-like cover-ups, to bras with removable flaps conducive for providing access to the breast. However, none of these commercially available products have successfully solved the issue of preventing a garment from falling back down over the breast as the infant attempts to nurse, and/or to free up a mother's hand to ease the use of a breast pump device. The problem with these draping ponchos is that once the garment has been pulled down over the breast feeding baby's head, the mother cannot be certain that the shirt, bra and/or other fabrics under the drape are not interfering with the suckling process and/or obstructing the nose and thus breathing of the infant. Consequently, breast feeding women are forced to opt for less desirable "attire" that is believed to be conducive to breast feeding, yet, on the contrary, are so often inappropriate in the work place.

There is a need for a garment securing device that can be conveniently worn at home and in the work place that provides consistent easy access, and availability at hand when it is time to nurse an infant. This is because the frequency required for feeding a newborn baby, dependent on it's size, can be as often as every 2 hours, around the clock, and as many as up to 8 to 12 feedings in a 24 hour time frame.

Just after the birth, during the early days of breastfeeding, a mother being able to maneuver her clothing away from the nipple latch-on area is vital to her success in breast feeding. The latch-on phase can be quite awkward and often complicated by various factors, such as by an engorged breast, inverted nipples, a frustrated infant having a receding jaw making latch-on an anatomical challenge, which is not uncommon in newborns. It is commonly understood that any apparatus or process that eases any part of the breast feeding process is a welcome and necessary benefit.

Choices for clothing has long been challenging for a new mother re-entering the workplace from maternity leave. A nursing mother's wardrobe is drastically limited, as her pre-pregnant attire is not currently available and likely stored away for later use. Unfortunately, nursing appropriate garments are not generally work appropriate and are uncomfortable for a nursing mother to be wearing in a professional environment. The returning mother oftentimes has to purchase expensive and limited specially made article of clothing designed to facilitate the nursing process as well as to promote a professional image.

Nursing mother's have long felt a need for a product capable of holding their garments in place during nursing. Sadly, there is currently no adornment in the marketplace capable of lifting and safely securing a wide variety of clothing styles, fabrics and weights. Regrettably, conventional fasteners cause wrinkles, marks, and/or oftentimes snag and tear fabrics. There is no product presently available capable of positioning a clothing garment as well as to securing it so that both of the mother's hands are free to align and attach the breast pump apparatus of her choice onto both her breasts simultaneously in an efficient manner.

Where nursing an infant is involved, safety is a major concern especially where the child may come into close contact with a particular product and may not be overlooked. Choking, strangulation, and other hazards inherent in various materials potentially available for production are also a large consideration in the development, manufacture and packaging of a suitable product. The product should adhere to various safety standards, such as guidelines set forth by the Consumer Products Safety Act, and the Juvenile Products Manufacturers Association, which are geared to focus on manufacturers of goods for primarily prenatal to pre-school aged children.

Additional challenges for the nursing mother arise upon her return to the work place; often only 6-8 weeks after giving birth. Here motivation is to her child. The mother of a newborn is often fatigued, and distracted from her child by her job related responsibilities and restrictions. Being separated from her child for extended periods of time causes sufficient frustration and anxiety. Most likely, this is the first separation from the newborn since conception. Compounding the anxiety is the drastic change, regardless of how highly anticipated the expected mother may have felt prepared. To make matters worse, once the working mother returns to work, expressing milk (e.g., by pumping) must be performed frequently in an 8 to 10 hour work day, in considerably less desirable, public environments. Unfortunately, expression is performed in a routine manner as dictated and regulated by the rigors of her workplace, not by her natural biological expression.

The set up, use, and maintenance of the breast pump apparatus, and milk storage are all obstacles for the working mother. These and other "glitches" previously noted are compounded by her personal needs for good nutrition, adequate hydration, satisfying her employer's expectations and the demands of her job description. Ideally, in these less private, awkward environments, the belabored mother would like to be able to very quickly draw her milk in a more efficient and relaxed manner. However, too few employers have the capital to set up lactation rooms where a nursing mother can go to and draw their beast milk by pumping. Even where one might be available, there is the added burden of finding a suitable place to inconspicuously refrigerate the breast milk throughout the day in order to prevent the milk from spoiling. Breast pump manufacturers have attempted to provide adequate equipment; some equipment even containing refrigeration components with the pump to safely store the breast milk. A number of women bring their own coolers in to work with them into which the milk may be stored. As described herein, there is an inordinate amount of equipment (e.g., the breast pump, the cooler, and possibly breast pads to safeguard garments from leakage, her lunch and/or additional fluid nourishment for herself) that the nursing mother must contend with every day. Breast pumps are time consuming and require substantial set up and cleaning, as well as the use of both hands during operation.

In the first three months after the birth of her baby frequent routine nursing and/or pumping is imperative to produce, increase, and maintain her milk supply. In the work place, time spent expressing milk from one's breast is deemed "personal use of company time." Consequently, restful and social break times are all too often forfeited by a mother needing instead to pump. Adding to this challenge, not all work environments are "family friendly," clean, private or comfortable places for the mother to express her breast milk. The mother's immediate motivation, her child's presence and cry, is of course, absent. Thus, experiencing separation anxiety, guilt, even grief is justifiably experienced by the mother returning to work.

Appropriate clothing, yet another burden to contend to, for a "nursing mother," may not be "work appropriate" attire and is fairly expense. The removal, adjustment of some clothing and the safeguarding of those garments, is a time consuming process and a detrimental point of consideration for a nursing mother. A device that can provide more efficient management of her clothing while nursing and/or pumping is highly desirable. The desired solution should free the user's hands, and meet with a mother's goal, to enhance, ease, and sustain her choice to breast feed, as well as to meet the mechanical and emotional needs of the mother, and her child. Unfortunately, as a consequence of the various challenges, it is all too easy for a women to give in to the pressures of all of the aforesaid obstacles and abandon her quest for producing breast milk, thereby resorting to a more convenient artificial formula substitute.

A mother's breast milk is the best nutrition for the infant because the breast milk provides an optimal mix of nutrients and antibodies naturally designed for the infant. It has been proven that breast fed babies have fewer and less serious illnesses overall. For example, the risk of occurrence of Sudden Infant Death Syndrome (SIDS), childhood cancer and obesity are dramatically reduced (as per WHO and Uniceff). Furthermore, not only is the production of breast milk nourishing for the child, but it is also healthy for the mother to produce.

During the period of breast feeding, a mother is assured with confidence that the child is receiving the best nutritional value during this time of rapid growth and development. Various other advantageous can be realized through breast feeding. As a result of the breast milk production, it is proven that the uterus or womb contracts returning to its pre-pregnancy state. Continued breast feeding also assists in the weight loss of the new mother, in addition to decreasing the risks of breast and ovarian cancer, as well as anemia and osteoporosis, and Type-2 diabetes. Another benefit to nursing is that both mother and baby enjoy each others emotional benefit and establish a special and close relationship.

Financial incentives realized through breast feeding are significant and all too often lost as a result of the difficulties involved with breast feeding. To their detriment, a significant financial burden is placed on the family. Less money is available for other essential goods and services. Heath costs are increased, and time away from the labor force to care for sick children is increased where the attempt to breast feed is not made. Various negative implications extend to the community and are further frustrated by the lack in breast feeding. That is, more tax resources are relied upon to care for an unhealthy infant in our society, thereby raising costs for health care, government assistance, and to third party payers.

In our current health care climate, the length of time a patient is allowed to occupy a hospital bed has decreased drastically and will continue to do so as hospitals, insurance companies, and Medicare attempts to reduce costs. Each day an increasing number of patients are untimely discharged from hospitals and "same day" outpatient surgical suites within hours of their critical procedures. Regardless of the length of the shortened "in house" stay, patients are discharged early and left to contend with various post surgery implements with minimal instructions for care. Patents are diverse and may range from a post cesarean section mother, to a middle aged man with a colostomy appliance. Unfortunately, assistance from alternate support services as provided by home care agencies, the Visiting Nurse Association, and family involvement may be limited, and not likely available 24 hours a day. Patients, in a semi-coherent, stressed and weakened state, are expected to learn quickly to fend for themselves, and to resort to their own resources for caregiving in between scheduled visits. Regrettably, patients have to return to their jobs earlier than prescribed for fear that they may lose their job, as well as the need to maintain their income and heath insurance among a host of other personal concerns.

It is clear that these problems have not been solved and there is still a longstanding need for a device that can aid in overcoming the disadvantages listed above by enabling a mother to prolong breast feeding. The challenges and expectations of motherhood can threaten a woman's self esteem, sense of empowerment, and confidence. Her new role as caregiver for an infant can leave her feeling inadequate, overwhelmed with responsibility, humbled, and vulnerable.

Unfortunately, there are so few products on the market that encourage a mother to prolong breast feed during the first year of life, i.e., a vulnerable and rapid growth period. As mentioned above, it is unanimously proven that a number of health benefits are received by a child who is able to breast feed for a prolonged period of time during the infancy period of a newborns life. A "newborn" may commonly be referred to from birth to 6 months of age, and an infant and be referred to from about birth to 1 year.

The magnetic securing device assembly described below is a unique device that allows a nursing mother to conveniently prolong the duration of nursing by breast feeding from weeks to months, to years, and solves a fundamentally longstanding need not previously addressed in child rearing.

SUMMARY

The present invention addresses the shortcomings identified in providing a magnetic securing device assemblies and methods capable of quickly and easily securing a garment away from the head and mouth of a nursing infant.

The magnetic securing device assembly may be worn as an ornamental piece of jewelry and is adapted to secure a garment away from a breast. The magnetic securing device assembly includes a first magnetic element, and a second magnetic element magnetically attracted to the first magnetic element. A cordcord is attached to at least one of the first or second magnetic elements. The first magnetic element is separated from the second magnetic element, and the first magnetic element is positioned on an opposite side of the garment, and in alignment with the position of the second magnetic element. The first magnetic element is magnetically fastened to the second magnetic element so that the garment is securely held away from the breast.

A method is provided for securing a garment away from a breast with a magnetic securing device assembly attached to a cordcord and worn as a necklace or bracelet. The method includes pulling a bottom edge of the garment up above the breast, and then tucking the magnetic securing device assembly and cordcord, from a front side of the garment, backward under the bottom edge of the garment. Then, upward under the back side of the garment toward a neckline of the garment to a position above the breast. The cord forms a tethered hook that holds the bottom edge of the garment above the breast. The first magnetic element is then separated from a second magnetic element attached to the cord. The first magnetic element is then positioned on the front side of the garment, in alignment with, and opposite the position of the second magnetic element.

The garment is then secured in place by magnetically fastening the first magnetic element to the second magnetic element.

According to another method for securing a garment away from a breast, a magnetic securing device assembly is attached to a cord and worn as a necklace or bracelet. The magnetic securing device assembly and cord are tucked back through a neckline of the garment, and down along the back side of the garment. The bottom edge of the garment is pulled up above the breast. The magnetic securing device assembly and cord are pulled up from behind the back side of the garment forward, up under a bottom edge of the garment, and back up the front side of the garment to a position above the breast. The cord forms a tethered hook that holds the bottom edge of the garment above the breast.

A first magnetic element is separated from a second magnetic element attached to the cord, and the first magnetic element is positioned on the back side of the garment, in alignment with, and opposite the position of the second magnetic element. The garment is secured in place by magnetically fastening the first magnetic element to the second magnetic element.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein:

FIG. 32 is an exemplary illustration of the magnetic securing device assembly worn as a pendant without the cord in accordance with this invention.

FIG. 33 depicts a cross sectional view of the pendant securing various layers of the garment with a retaining loop hole disposed through the faceplate in accordance with this invention.

FIG. 34 shows a side view of the pendant securing various layers of the garment with a retaining loop disposed through the faceplate in accordance with this invention.

FIG. 35 depicts a cross sectional view of the pendant securing various layers of the garment with a retaining loop disposed through the rear plate in accordance with this invention.

FIG. 36 shows a side view of the pendant securing various layers of the garment with a retaining loop disposed through the rear plate in accordance with this invention.

FIG. 37 is an exploded view of the magnetic securing device assembly embodied as a bracelet in accordance with this invention.

FIG. 38 is an exemplary illustration of a magnetic securing device assembly worn as a bracelet in accordance with this invention.

FIG. 39 depicts a cross section view of the magnetic securing device assembly embodied as a bracelet including a retaining loop in a faceplate in accordance with this invention.

FIG. 40 depicts a side view of the magnetic securing device assembly embodied as a bracelet including a retaining loop in a faceplate in accordance with this invention.

FIG. 41 depicts a cross section view of the magnetic securing device assembly embodied as a bracelet including a retaining loop in a rear plate in accordance with this invention.

FIG. 42 depicts a side view of the magnetic securing device assembly embodied as a bracelet including a retaining loop in a rear plate in accordance with this invention.

FIG. 55 is a close up view of the first portion and the second portion of the magnetic securing device assembly being attached by the cord at another exemplary location in accordance with this invention.

FIG. 56 is a close up partial cross section view of the first portion and the second portion of the magnetic securing device assembly being attached by the cord at the other exemplary location in accordance with this invention.

FIG. 57 is a partial cross section view of the magnetic securing device assembly placed on opposite ends of a garment and being magnetically secured together in accordance with this invention as shown in FIG. 57.

FIG. 58 shows another exemplary method for securing the magnetic securing device assembly around a garment in accordance with this invention as shown at FIG. 56.

FIG. 59 shows yet another exemplary method for securing the magnetic securing device assembly around a garment in accordance with this invention.

FIG. 60 illustrates another exemplary shape for a first portion and a second portion of the magnetic securing device assembly being attached to a cord in accordance with this invention.

FIG. 61 is another exemplary illustration of a magnetic securing device assembly being worn as a bracelet in accordance with this invention.

FIG. 62 is a close up view of the first portion and the second portion of the bracelet magnetic securing device assembly and cord encircling a portion of a garment in accordance with this invention.

FIG. 63 is a view of the bracelet magnetic securing device assembly and cord encircling the portion of a garment on the user in accordance with this invention as shown in FIG. 62.

FIG. 64 is a view of the bracelet magnetic securing device assembly and cord partially encircling over a portion of the garment in accordance with this invention as shown in FIG. 52.

DETAILED DESCRIPTION OF EXEMPLARY EMBODIMENTS

Figure 1:
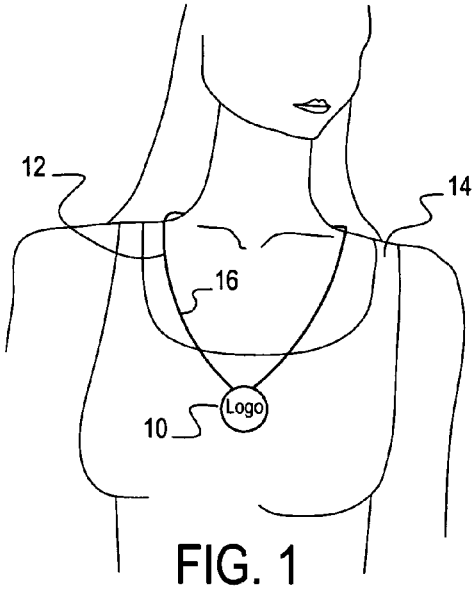
FIG. 1 is an exemplary illustration of a magnetic securing device assembly worn as a necklace about a user in accordance with this invention.

Particular embodiments of the present invention will now be described in greater detail with reference to the figures. Various benefits may be provided by an exemplary garment securing device assembly described below, shown in the figures, and various alternative embodiments within one skilled in the art.

In brief, the garment securing device is a magnetic securing device adapted to encourage prolonged breast feeding (sustained lactation) by making the breast feeding process more convenient and encouraging. The magnetic securing device saves time and money for the nursing mother and her support group. The magnetic securing device fosters a break from the drab conventional maternity attire by making more clothing options possible, in accordance with a user's personal style and needs.

The magnetic securing device decreases the nursing mother's time spent away from her job responsibilities. Likewise, the magnetic securing device assembly also protects her clothing, and eliminates the need for separate clothing and expense for the duration of her nursing calendar. The magnetic securing device assembly aims to facilitate the ease with which a nursing mother can efficiently continue to nurse well after they have returned to work. Equally importantly, is the ability to empower a nursing mother with a sense of reassurance that they can conveniently provide the benefits of breast milk, in the absence of their presence from home, as well as from the presence of their infant.

The magnetic securing device assembly solves a fundamentally longstanding need not previously addressed by other infant products. That is, the magnetic securing device assembly lifts and secures a garment of clothing, in a manner not previously performed in order to facilitate the breast feeding experience. The magnetic securing device assembly may be designed and configured as an ornamental device. The aesthetics of the ornamental magnetic securing device assembly may be desirably worn by the user as a piece of jewelry. The aesthetic nature of the magnetic securing device assembly can be worn by a mother to contribute a sense of individual expression to her pride, and in her new role as a mother.

The magnetic securing device assembly is versatile and may be worn as a necklace, a bracelet, a broach or the like. The convenient placement of the magnetic securing device assembly when worn as a decorative piece of jewelry is close at hand and conveniently accessible for use by the mother on a moments notice, which so frequently occurs when the infant becomes hungry and agitated nearly instantaneously. The use and convenience of the magnetic securing device assembly, allows the mother to focus on her baby. The aesthetic magnetic securing device assembly is conveniently available all times during the "around the clock feedings" at home, and/or elsewhere. As such, a mother is able to fulfill her person goal of prolonged breast feeding, while being able to meet the challenges of breast feeding in an efficient manner. During this otherwise intense and brief time period, when the mother-baby relationship is nurtured, a mother's newfound ability to effortlessly breast feed bestows upon her a sense of empowerment and independence.

The magnetic securing device assembly is constructed as a universal assembly that may be modified to increase various wearable and access options to the breast feeding mother. For example, and as will be described in more detail later, a "cord" may be incorporated as part of various embodiments, to bear the weight, and enhance the "lifting" function (e.g., a upward lift) of the garment for breast feeding mothers. Convenience, versatility, and efficiency are realized with the use of the aesthetic magnetic securing device assembly.

The magnetic securing device assembly encourages a mother to continue to breast feed through the infancy period (from birth to about 6 months), and as long as possible thereafter. Ideally, a mother will continue to breast feed beyond 12 months. Various features and functionality contribute to the utility of the magnetic securing device assembly, such as for example: the convenience provided by a continually wearable article, both in and out of the home; efficiency in maintaining lift and security for the mother's attire while effectively exposing the breast.

Another aspect of this invention is to provide a construction that is safe to the infant, as well as being gentle in use with various delicate fabrics, such as silk, rayon, chiffon, and the like. Benefits to the infant being nursed are another fundamental factor, equally as motivating as the mother's support. The use of the magnetic securing device assembly allows a mother to adequately view the baby while the infant is being nursed. The enhanced visibility enables the mother to ensure that the baby's nasal passages remain unobstructed due to the engorged breast tissue, the garment falling in the way and/or other factors, such as positioning. The magnetic securing device assembly saves time, and reduces frustration for the mother and baby in many ways including by eliminating the distraction of loose clothing falling in the way of the nursing baby. Disruption of the nursing, such as to the infant's nasal passage or other breathing obstruction, can result in wasting the limited precious breast milk as the infant pulls away to "catch a breath." The magnetic securing device allows increased skin to skin contact between the baby and breast of the mother.

The magnetic securing device assembly increases the freedom in the use of the mother's hands. At least one free hand is available to allow the mother to assist her infant in "latching on" to her breast. This freedom is particularly useful in and away from the home, especially where a breast pump is used. In use, both of the mother's hands are free, and available to manipulate the cumbersome breast pump apparatus. Pumping can be done with less overall stress and performed more efficiently thereby decreasing the time away from work related responsibilities. Ideally, the time needed to extract breast milk at a job site will decrease and allow the mother to pump more frequently, which is imperative to increasing and maintaining the production of breast milk. In this scenario, both of the mother's hands are free to be able to position and use both pumps without having to be concerned for her clothing falling, thereby saving her substantial time and increasing efficiency.

The aesthetic appeal of the magnetic securing device assembly increases the user's desire to wear the device, as well as to express a sense of individuality and increased confidence. More intimately, the magnetic securing device assembly may be considered an aesthetic personal adornment designed to support and enhance the breast feeding mother's choice. For example, a mother's self esteem, her personal sense of identity, only known to herself, and on a quiet personal level, as a woman who has undertaken the daunting task of birth and child rearing can be reflected and memorialized in the wearing of the magnetic securing device assembly. The magnetic securing device assembly is a useful talisman connecting her with her infant, as well as to celebrate her choice and to confirm her commitment to supply the remarkable nutrition of her breast milk to her child, much like a wedding band symbolizes a firm commitment to a marriage.

Equally important, clothing options to the mother are increased because the mother can optionally wear her pre or post-pregnancy attire, as well as her nursing attire, by leveraging the convenience of the magnetic securing device assembly. Overall cost of additional clothing and attire to a new mother is decreased due to the expansion of clothing options available through the use of the magnetic securing device assembly. This benefit is appealing to a new mother desiring to rejuvenate her appearance by allowing her to move away from maternity and/or conventional nursing attire. Notably, in the workplace where "nursing appropriate" may not equate with "work appropriate," sparing cost and the time spent shopping for clothing can be a plus. Also, the time needed to manipulate her clothing to expose her breast is dramatically decreased. Furthermore, the expense of purchasing formula is eliminated where breast feeding is successful.

The various benefits provided by breast feeding for infants as well as their mothers are resonated in various articles and extend well beyond the period of time, months, devoted to breast feeding/or receiving breast milk's nourishment. The various publications, some of which are referred to above, empirically emphasize a myriad of benefits the role breast feeding plays in the development of an infant through sustained prolonged lactation well beyond the inflexible time frame (typically 6-8 weeks) allotted for "maternity leave" as offered by most employers.

The magnetic securing device assembly serves to increase the length of time the mother is allowed to breast feed from weeks to months and to therefore sustain lactation by increasing her efficiency and motivation. By increasing the expression of her breast milk over a period of time (e.g., over weeks/months), as well as to increase the frequency daily during the first 3 months of life, sustained lactation is made possible to increase the production of breast milk and the quantity made available. By leveraging the use of the magnetic securing device assembly, disruption of this fundamentally important rhythm is no longer in issue, particularly for a new mother returning to the labor force.

In addition to the notable statistical advantages of prolonged breastfeeding for infants, there are other equally important benefits a mother gains from being able to provide breast milk for her child. The advantages for the mother who can sustain lactation are numerous, to name a few include: a more rapid return to her pre-pregnancy body weight as well as body tone, overall reduced risks of breast cancer, ovarian cancer, type 2 diabetes, anemia, and osteoporosis. It is proven that a mother, who can continue to nurse for a period of time well beyond seven weeks acquires a sense of empowerment and confidence in her innate ability to sustain lactation thereby being able to provide her nutritionally complete breast milk for her child.

The breast milk supplies the optimal combination of nutrients, albeit some identified solely in breast milk, along with immunity boosting antibodies. Breast fed babies have fewer and less serious infections ranging from ear infections to pneumonia. A breast fed child is less susceptible to SIDS, childhood diabetes, obesity, and cancer. Likewise, breast fed children have also demonstrated slightly higher IQ's in some studies.

The magnetic securing device assembly has a variety of different possible uses, such as during post-operative and convalescent period for surgical patients. An increasing number of these patients need to expose the torso portion of their body for various reasons, such as: to maintain a healing wound or incision; to change a dressing or pack a wound; manipulate a prosthetic device, as well as various stoma appliances needed after an intestinal operation. Attention to various appliances may include, for example, maintaining a drain(s) and/or the drainage thereof. Economically, the magnetic securing device assembly can reduce the number of doctor visits anticipated. As a result, less drain on the reliance of insurance compensation is needed, as well as inconsistent outside help. Overall, the magnetic securing device assembly fosters a faster and safer recovery for the patient.

In use, the magnetic securing device assembly may be adjusted for an intended use in order to effectively provide lift and exposure of a portion of the body, such as the chest and/or abdomen and/or any areas needing attention or maintenance. The lift and exposure may be fixed by the recovering patient for whatever sustained period of time as required for the task's completion. Contamination of the post surgical site by the clothing and/or drainage may be effectively eliminated. The patient's hands are free to perform the necessary tasks for dressing removal and replacement. Removing and adjustment of the user's clothing may be performed easily in traditionally inconvenient environments, such as public restrooms in a more efficient and sanitary manner.

The utility of this device increases efficiency, decreases stress, and increases safety for the user. The user's confidence, self esteem and independence may be improved.

FIG. 1 is an exemplary illustration of a magnetic securing device assembly 10 worn as a necklace 12 having a cord 16 about a user in accordance with this invention. In use, the magnetic securing device assembly 10 is a garment securing mechanism used for securing an upper garment 14 away from the user's breast when the nursing mother breast feeds an infant.

Figure 2:
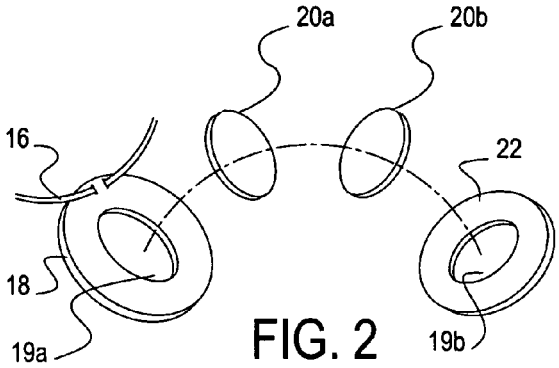
FIG. 2 is an exploded view of the magnetic securing device assembly in accordance with this invention.

FIG. 2 depicts an exploded perspective view of the magnetic securing device assembly 10. As shown, the magnetic securing device assembly 10 includes the cord 16, a faceplate 18 having a first recess 19*b*, a first magnetic element 20*a*, a second magnet element 20*b* within a second recessed rear plate 22. The magnetic securing device assembly 10 integrates the use of at least one magnet and at least one magnetic attractive material as will be described in more detail later to secure a garment in place.

Figure 3:
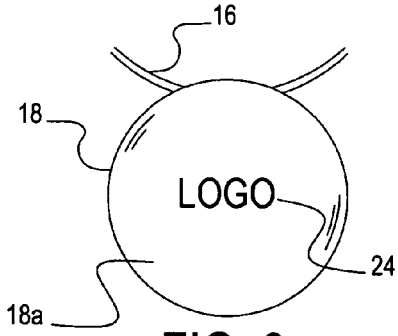
FIG. 3 is a front side view of the magnetic securing device assembly in accordance with this invention.

FIG. 3 is a front view of the magnetic securing device assembly 10. As shown, the front side 18*a* of the faceplate 18 may be decorative and/or may include a logo 24, for example, a design and/or some other type of indicia. The front side 18*a* of the faceplate 18 may include jewels or other precious metal item. Various types of decorative designs may be constructed on the front side 18*a*, such as, engravings, etchings, geometric shapes, company logos or group affiliations, flags, insignia, awards, religious ornamentation, a licensed character and/or any other type of ornamental or aesthetic design. The faceplate 18 may be constructed of an endless array of shapes, sizes, colors and other design may be included on the front side 18*a* of the faceplate 18 without interfering with the functionality of the device. The various designs on the faceplate 18 may be interchanged with one another without inhibiting the functionality of the overall device.

Figure 4:
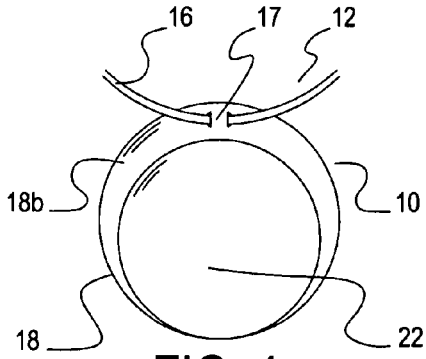
FIG. 4 illustrates a rear side view of the magnetic securing device assembly in accordance with this invention.

FIG. 4 illustrates a rear view of the magnetic securing device assembly 10. An exemplary cord connection is shown in which the cord 16 of the necklace 12 is captivated by a retaining loop 17 constructed on the rear side 18*b* of the faceplate 18. It is to be understood that the cord 16 and the retaining loop 17 may, in the alternative, be constructed on the front side 18*a* of the faceplate 18, the front side 22*a* of the rear plate 22, the rear side 22*b* of the rear plate 22 and/or any other suitable arrangement for attaching the cord 16. The retaining loop 17 may be constructed as any type of retaining members in which the cord 16 may be fastened to the faceplate 18 of the magnetic securing device assembly 10.

The cord 16 may be comprised of any number of various materials, including but not limited to, metal, material, twine, nylon, a polymer, and/or any material suitable in strength to hold up a garment that is now known or later discovered in accordance with this invention. As will be described in more detail later, the cord 16 may be an adjustable cord capable of being extended and contracted in length for wearing on a person and/or to efficiently position the magnetic securing device assembly 10 on the garment at a preferred height.

Figure 5:
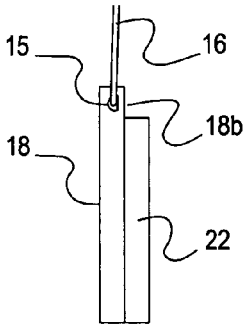
FIG. 5 shows a side view of the magnetic securing device assembly in accordance with this invention.
Figure 6:
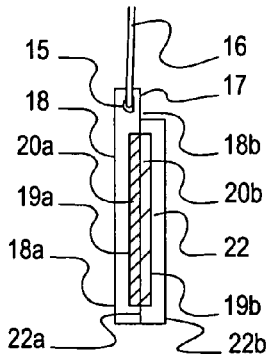
FIG. 6 depicts a side cross section view of the magnetic securing device assembly in accordance with this invention.

FIG. 5 illustrates a side view of the magnetic securing device assembly 10 in accordance with this invention. In FIGS. 5 and 6, the cord 16 is shown attached to the rear side 18*b* of the faceplate 18, and the second magnetic element 20*b* disposed within the rear plate 22 is secured to the first magnetic element 20*a* disposed within the faceplate 18.

In more detail, FIG. 6 depicts a side cross section view of the magnetic securing device assembly 10. As shown, the first magnetic element 20*a* is disposed within the recess 19*a* on the rear side 18*b* of the faceplate 18. It is to be understood that various adhesive materials and/or processes may be employed to secure the first magnetic element 20*a* to the faceplate 18. For example, the first magnetic element 20*a* (or second magnetic element 20*b*) may be attached to the faceplate 18 (or rear plate 22) by an epoxy, a resin, a weld, fusing and/or any other suitable process for securing the first magnetic element 20*a* to the faceplate 18.

Although in FIG. 6 the first magnetic element 20*a* is shown counter sunk into the first recess 19*a* on the rear side 18*b* of the faceplate 18, it is to be understood that the first magnetic element 20*a* may be partially embedded within the faceplate 18, and/or the second magnetic element 20*b* may be completely counter sunk and/or encased within a rear plate 22. The faceplate 18 and the rear plate 22 may be composed of a magnetic inductive composite material capable of conveying the magnetic attraction between the first magnetic element 20*a* and the second magnetic element 20*b* without any substantial loss to the magnetic attraction between the two magnetic element materials. It is to be understood that the various components of the of the magnetic securing device assembly 10 may be constructed of varying size and shape to accommodate a variety of different configurations in accordance with this invention.

As shown in FIGS. 5-6, the cord 16 is disposed within an in-set through-hole 15 formed in the retaining loop 17 such that the rear side 18*b* surface of the faceplate 18 into which the retaining loop 17 is formed does not include an extrusion and the rear side of the faceplate 18 remains substantially flush throughout. However, it is to be understood that the retaining loop 17 may be embodied in a variety of different ways which may or may not include an extrusion, various recesses, additional pieces, and the like in accordance with this invention.

Although this embodiment may define the first magnetic element 20*a* and the second magnetic element 20*b* as rare Earth materials, it is to be understood that either the first magnetic element 20*a* or the second magnetic element 20*b* may be made of any type of magnetically attractive material to achieve the lowest cost without sacrificing functionality. For example, the first magnetic element 20*a* may be a magnet or a magnetically attractive material, such as a metal, likewise, the second magnetic element 20*b* may also be a magnet or a magnetically attractive material. In use, the first magnetic element 20*a* may be a magnet and the second magnetic element 20*b* may be a magnetically attractive material. The reverse is also possible. Likewise, both the first magnetic element 20*a* and the second magnetic element 20*b* may both be magnets. Both the magnets and the magnetically attractive materials may be selected from a plurality of different magnetic materials, metals and/or other composite including suitable magnetic properties for use to create a sufficiently strong magnetic attraction in accordance with this invention.

The first magnetic element 20*a* and/or the second magnetic element 20*b* may be made from a highly magnetically attractive rare Earth material, such as Neodymium Iron Boron (i), sintered to form a permanent magnet, and/or any other material having strong magnetic attractive force properties in accordance with this invention. It is to be understood that various magnetically attractive magnets and/or material fasteners having attraction force properties may be used which are, now known or later discovered, in accordance with this invention.

Figure 7:
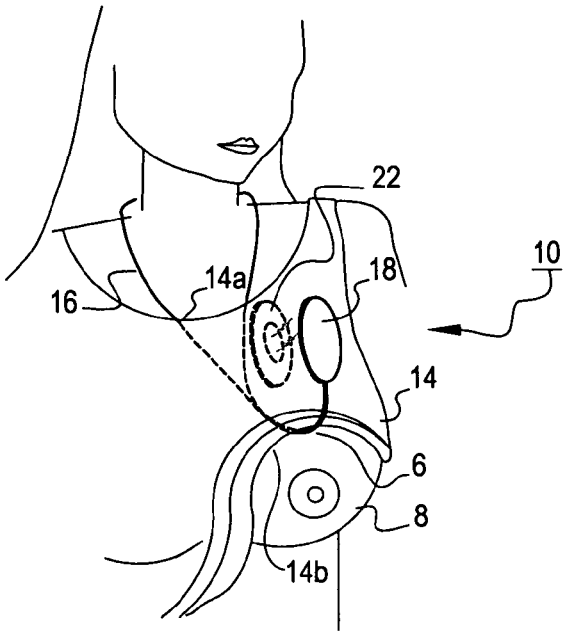
FIG. 7 illustrates an exemplary method for securing the magnetic securing device assembly onto a garment by employing the under and over method for securing in accordance with this invention.
Figure 8:
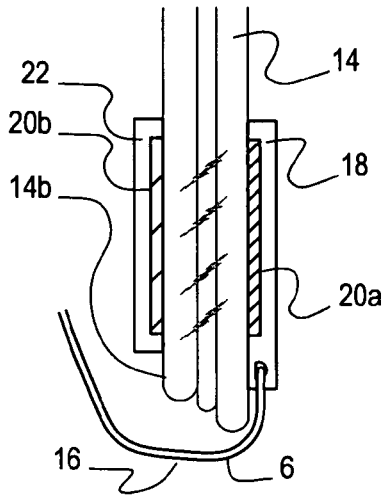
FIG. 8 depicts a cross section view of the magnetic securing device assembly according to the method illustrated in FIG. 7.

FIGS. 7 and 8 demonstrate a first exemplary method for securing the upper garment 14 using the magnetic securing device assembly 10 in order to efficiently and conveniently nurse an infant. Briefly stated, the method for using the magnetic securing device assembly 10 shown in FIG. 7 follows a process where the magnetic securing device assembly 10 is flipped "under and over" the garment 14 into an operative position.

In particular, and as shown in FIGS. 7-8, the cord 16 is attached to the faceplate 18 of the magnetic securing device assembly 10. The magnetic securing device assembly 10 is tucked behind through the neckline 14*a* of the garment 14, down along the back side of the garment 14, up under a bottom edge 14*b* of the garment 14, and back up the front of the garment 14 and brought to rest at a position above a breast 8 so that the breast 8 may be exposed in order to nurse an infant. The integrated second magnetic element 20*b* and the rear plate 22 is disconnected from the first magnetic element 20*a* and the faceplate 18, and are positioned behind the garment 14 at about the same position where the first magnetic element 20*a* in the faceplate 18 is located at the front of the garment 14. When the first magnetic element 20*a* and the second magnetic element 20*b* are aligned with each other at the predetermined position on opposite sides of the garment 14, they are brought together so that the magnetic force created between first magnetic element 20*a* and the second magnetic element 20*b* are allowed to secure the garment in place.

The cord 16 fed up under the bottom edge 14*b* of the garment 14 forms a tethered hook 6 just under the lower end 14*b* of the lifted garment 14 and is adapted to keep the garment 14 in position above the breast 8, as shown in FIG. 7. The lowermost portion of the tethered hook 6 holds the garment 14 up at a predetermined height above the breast. The height of the garment 14 can be varied in position above the breast by the user in response to her desired positioning of the first magnetic element 20*a* and the second magnetic element 20*b* on the garment 14.

For example, if the height of magnetic securing device assembly 10 is moved up, the height of the lowermost portion of the tethered hook 6 and the garment 14*b* will also move upward, and higher away from the breast. Likewise, if the height of the magnetic securing device assembly 10 is moved downward, the height of the lowermost portion of the tethered hook 6 will also move downward allowing the lower end 14*b* of the garment 14 to cover the breast 8.

FIG. 8 depicts a closer partial cross section view of the magnetic securing device assembly 10 fastened around a portion of the garment 14 as shown in FIG. 7. The first magnetic element 20*a* recessed within the faceplate 18 is located on an outside of the garment 14. The second magnetic element 20*b* and rear plate 22 are positioned inside of the garment 14, opposite the first magnetic element 20*a*. In position, a magnetic attraction is created that biases the first magnetic element 20*a* toward the second magnetic element 20*b*, and visa versa to secure the garment 14 in place.

Various advantages are evident from the use of this magnetic securing device assembly 10 for the various reasons described above and those defined below. First, the magnetic securing device assembly 10 is efficient and easy to use, and can be simply manipulated with a single hand while the nursing mother carries an infant with the other hand. By employing the use of the magnetic securing device assembly 10, the garment 14 may be conveniently moved, and secured, away from the breast feeding infant. The garment 14 will not fall onto the infant's face or mouth thereby impeding the suckling process. Furthermore, the magnetic securing device assembly 10 is portable and may be constructed as a decorative piece of jewelry which will encourage the nursing mother to inconspicuously and conveniently carry the magnetic securing device assembly 10 on their person at all times, thereby promoting prolonged breast feeding and fostering a healthier infant.

Figure 9:
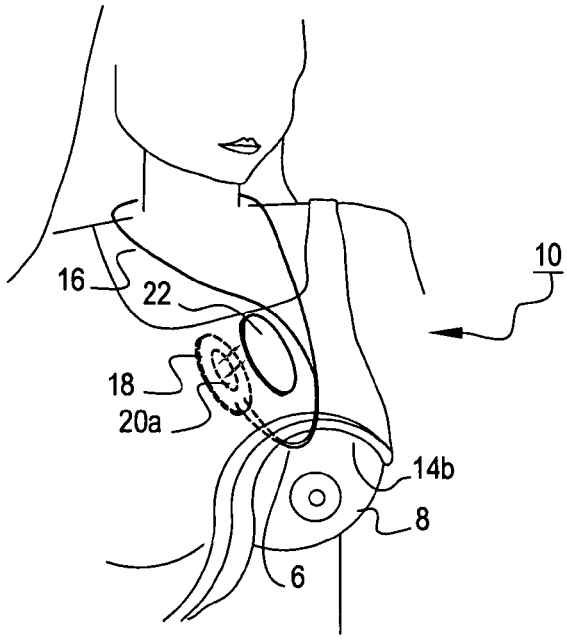
FIG. 9 illustrates another exemplary method for securing the magnetic securing device assembly onto the garment by employing the over and under method for securing in accordance with this invention.
Figure 10:
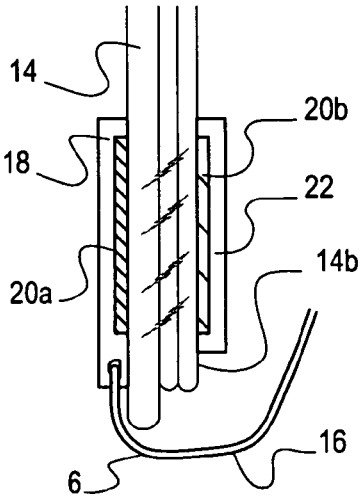
FIG. 10 depicts a cross section view of the magnetic securing device assembly according to the method illustrated in FIG. 9.
Figure 11:
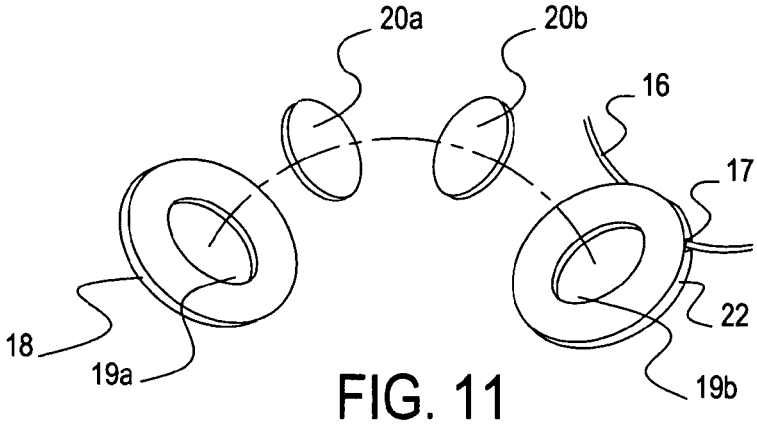
FIG. 11 is an exploded view of the magnetic securing device assembly fastened to the rear plate in accordance with this invention.

FIGS. 9 and 10 depict another exemplary method for securing a garment 14 away from the breast 8 of a nursing mother by employing the use of the magnetic securing device assembly 10. Generally stated, the magnetic securing device assembly 10 is flipped "over and under" the garment 14 into a position optimal for breast feeding the infant.

In particular, the faceplate 18 and the first magnetic element 20*a* of the magnetic securing device assembly 10 are disconnected from the combined second magnetic element 20*b* and rear plate 22, and are tucked up under the bottom edge 14*b* of the garment 14 from the front of the garment 14 backward. The first magnetic element 20*a* is then brought back upward along the back side of the garment 14 and brought to rest at a predetermined position above a breast 8 conducive for exposing the breast for breast feeding the infant. The second magnetic element 20*b* is then positioned in front of the garment 14 at the predetermined position, opposite the location where the first magnetic element 20*a* is located on the back side of the garment 14. When the first magnetic element 20*a* and the second magnetic element 20*b* are aligned with each other at the predetermined position on opposite sides of the garment 14, a magnetic force (as shown by magnetic bolts in FIGS. 8 and 10) is created between the first magnetic element 20*a* and the second magnetic element 20*b* that magnetically secures them at the predetermined position.

As shown in FIG. 10, the cord 16 is tucked up under the bottom edge 14*b* of the garment 14 and forms a tethering hook 6 that secures the garment at the desired predetermined height. The lowermost portion of the tethering hook 6 holds the garment 14 up at the predetermined height above the breast 8. As before, the height of the garment 14 is adjustable and may be varied based on the secured predetermined position of the first magnetic element 20*a* and the second magnetic element 20*b* on the garment 14. That is, if the height of the first magnetic element 20*a* and the second magnetic element 20*b* are moved upward, the height of lowermost portion of tethered hook 6 and hence the lower end 14*b* of the garment 14 will also move upward. On the contrary, if the magnetic securing device assembly 10 is moved downward, the height of lowermost portion of tethered hook 6 and hence the garment 14 may also be move downward.

FIG. 10 depicts an exploded partial cross section view of the magnetic securing device assembly 10 fastened around a portion of the garment 14, as shown in FIG. 9. The first magnetic element 20*a* recessed within the faceplate 18 is positioned inside of the garment 14. The second magnetic element 20*b* recessed within the rear plate 22 is positioned outside of the garment 14, opposite the first magnetic element 20*a*, at the predetermined position. In position, a magnetic force is created between the first magnetic element 20*a* and the second magnetic element 20*b* sufficiently strong enough to secure them in place at the predetermined position.

FIGS. 11-14 illustrate another arrangement for the magnetic securing device assembly 10. The magnetic securing device assembly 10 may be constructed in a number of different ways. By way of example, FIGS. 11-14 show the cord 16 connected through a retaining loop 17 constructed on the second magnetic element second magnetic element 20*b*, instead of the faceplate 18 as shown in FIG. 2. In this alternative, the second magnetic element 20*b* is housed within the rear plate 22 and the rear plate 22 is constructed to incorporate the retaining loop 17 into which the cord 16 is disposed.

Figure 12:
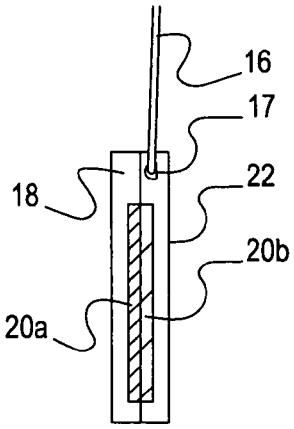
FIG. 12 illustrates a partial cross section side view of the magnetic securing device assembly fastened to the rear plate in accordance with this invention.
Figure 13:
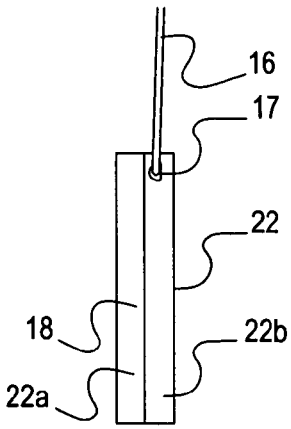
FIG. 13 shows a side view of the magnetic securing device assembly fastened to the rear plate in accordance with this invention.
Figure 14:
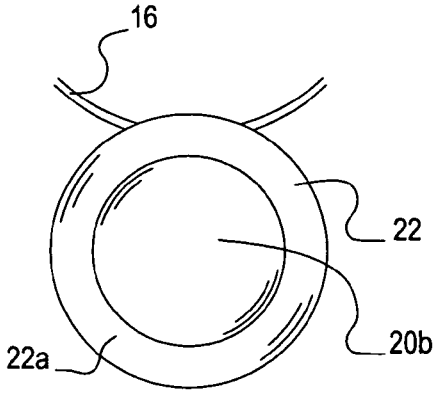
FIG. 14 depicts a front view of the rear plate of the magnetic securing device assembly fastened to the rear plate in accordance with this invention.

As shown in better detail in FIGS. 12-13, the retaining loop 17 is incorporated into the rear plate 22, into which the cord 16 is received. FIG. 14 is a front side 22*a* view of the rear plate 22 of the magnetic securing device assembly 10 showing the second magnetic element 20*b* recessed within the rear plate 22 and the cord 16 being received by the retaining loop 17.

Figure 15:
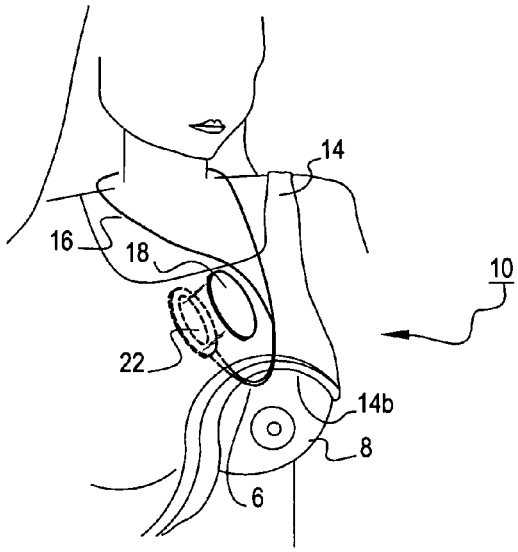
FIG. 15 illustrates another exemplary method for securing the magnetic securing device assembly fastened to the rear plate onto a garment by employing the over and under method for securing in accordance with this invention similar to FIG. 7.
Figure 16:
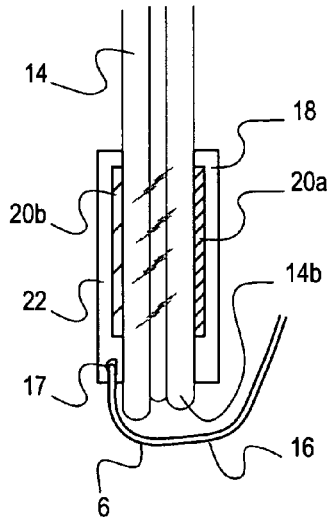
FIG. 16 depicts a cross section view of the magnetic securing device assembly according to the method illustrated in FIG. 15.

FIGS. 15-16 illustrate an "over and under" technique used in order to position the under garment 14 away from the breast 8. As shown in FIG. 15, the combined second magnetic 20*b* and rear plate 22 is tucked from the front of the garment 14, up under the bottom edge 14*b* of the garment 14, and then pushed back upward along the back side of the garment 14 and brought to rest at a predetermined position above the breast 8. The first magnetic element 20*a* is then positioned in front of the garment 14 at the predetermined position where the second magnetic element 20*b* is located on the opposite side of the garment 14. A magnetic force is created between the first magnetic element 20*a* and the second magnetic element 20*b* that secures them in place at the predetermined position.

FIG. 16 shows the cord 16 tucked up under the bottom edge 14*b* of the garment 14 acting as a tethering hook 6. The lowermost portion of the tethering hook 6 holds the garment 14 up at the predetermined height above the breast 8 as shown in FIG. 15. As described before, the height of the bottom edge 14*b* of the garment 14 can be adjusted and is based on the predetermined position secured by the first magnetic element 20*a* and the second magnetic element 20*b* on the garment 14. In position, a magnetic force is created between the first magnetic element 20*a* and the second magnetic element 20*b* that acts to secure them in place at the predetermined position.

Figure 17:
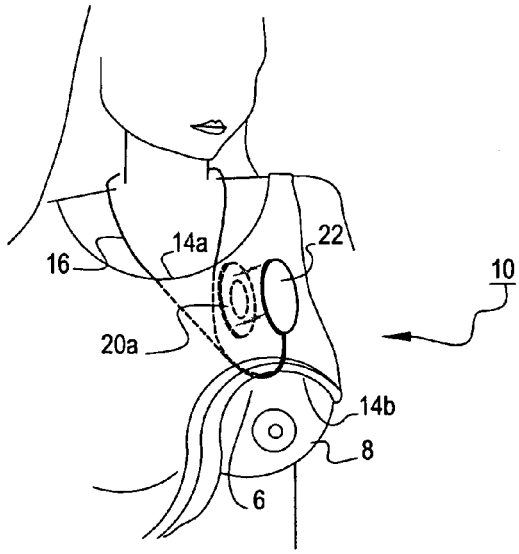
FIG. 17 illustrates another exemplary method for securing the magnetic securing device assembly fastened to the rear plate onto the garment by employing the under and over method for securing in accordance with this invention.
Figure 18:
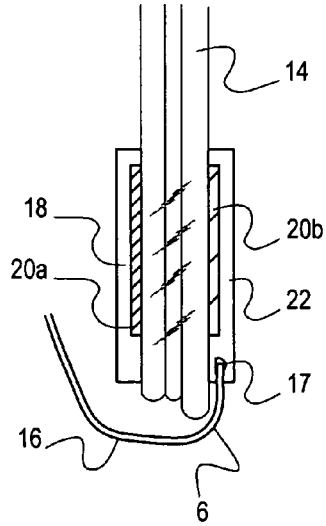
FIG. 18 depicts a cross section view of the magnetic securing device assembly fastened to the rear plate according to the method illustrated in FIG. 17.

FIGS. 17-18 illustrate the use of an "under and over" technique for the magnetic securing device assembly 10. The cord 16 attached to the second magnetic element 20*b* and the rear plate 22 is tucked back through the neckline 14*a*, down along the back side of the garment 14, and back up under the bottom edge 14*b* of the garment 14 and brought to rest at a predetermined position above a breast 8 so that the breast 8 is exposed for nursing an infant. The first magnetic element 20*a* is separated from the second magnetic element 20*b* and positioned behind the garment 14 at the predetermined position where the second magnetic element 20*b* is similarly positioned at the front of the garment 14. A magnetic force is created between first magnetic element 20*a* and the second magnetic element 20*b* to secure the garment 14 in position during nursing.

As shown in FIGS. 17-18, the lowermost portion of the cord 16 under the garment 14 forms a tethered hook 6 adapted to hold the garment 14 up to a predetermined height above the breast 8. The height of the garment 14 can be adjusted into any desired predetermined position by moving the first magnetic element 20*a* located inside the garment 14 and the second magnetic element 20*b* located outside of the garment 14 up or down along the garment 14 over the breast 8 to a preferred position opposite the first magnetic element 20*a*.

Figure 19:
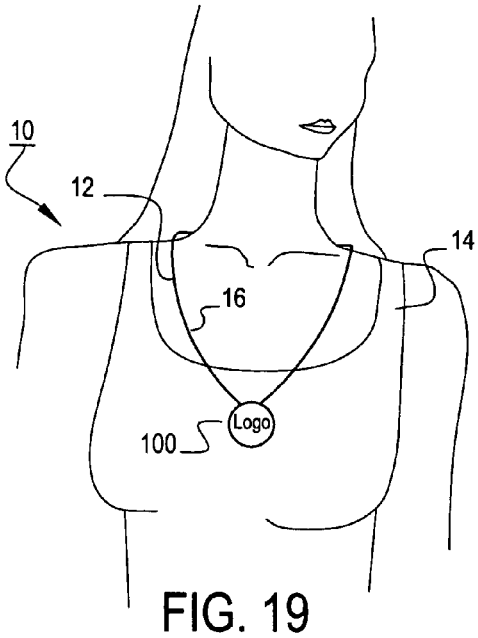
FIG. 19 illustrates another exemplary embodiment for a magnetic securing device assembly including a multiple magnet assembly in accordance with this invention.

FIG. 19 illustrates another exemplary embodiment for a magnetic securing device 10 embodied as a multiple magnet assembly 100 in accordance with this invention. As shown, the multiple magnet assembly 100 is arranged in a closed configuration and is worn as a necklace 12.

Figure 20:
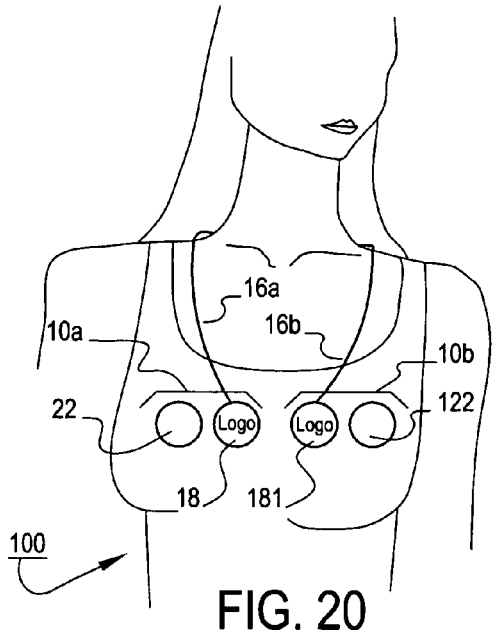
FIG. 20 shows the multiple magnet assembly separated for use with a cord attached to the faceplates of the multiple magnet assemblies in accordance with this invention.

As shown in FIG. 20, the multiple magnet assembly 100 comprises a pair of magnetic securing devices assemblies 10*a*, 10*b* constructed for beneficial use with a nursing mother having more than one infant and needing to simultaneously breast feed both of the infants simultaneously. That is, the multiple magnet assembly 100 is adapted to provide simultaneous exposure to both breasts 8. As such, both of the infants may nurse from the breasts at the same time without the upper garment 14 interfering with, or obstructing the infants from suckling the mother's breasts.

FIG. 20 shows the multiple magnet assembly 100 in an open configuration in which the first magnetic securing device assembly 10*a* is separated from the second magnetic securing device assembly 10*b*. The multiple magnet assembly 100 includes a first magnetic securing device assembly 10*a* and a second magnetic securing device assembly 10*b*.

As shown, the first magnetic securing device assembly 10*a* includes a first faceplate 18 having a first magnetic element 20*a* (as shown in FIG. 2) recessed therein and attached to a first cord portion 16*a* of the cord 16. The first magnetic securing device assembly 10*a* also includes a rear plate 22 having a recessed second magnetic element 20*b* (as shown in FIG. 2).

The second magnetic securing device assembly 10*b* of the multiple magnetic securing device assembly 100 includes a includes a second faceplate 181 having a first magnetic element 20*a* (as shown in FIG. 2) recessed therein and attached to a second cord portion 16*b* of the cord 16. The second magnetic securing device assembly 10*b* also includes a second rear plate 122 having a recessed second magnetic element 20*b*.

Figure 21:
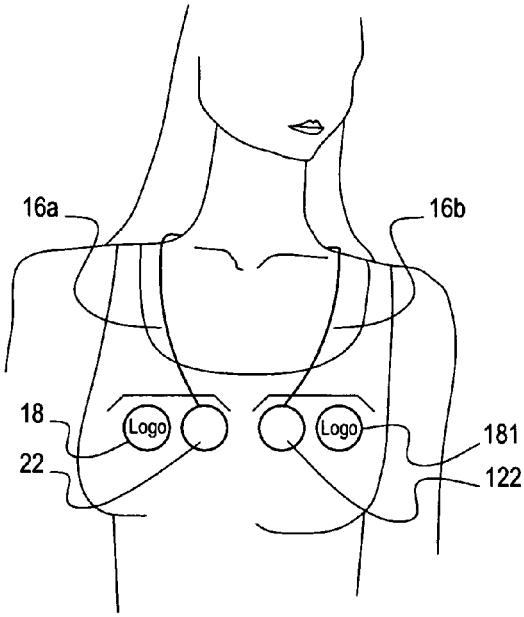
FIG. 21 shows the multiple magnet assembly separated for use with a cord attached to the rear plate of the multiple magnet assemblies in accordance with this invention.

FIG. 21 shows an alternative construction in which the rear plate 22 and the rear plate 122 are secured and for use with the first cord portion 16*a* and the second cord portion 16*b* respectively. The multiple magnet assembly 100 shown in FIG. 21 functions similar to the multiple magnet assembly 100 shown in FIG. 20 as will be described in more detail in FIGS. 22-24.

Figure 22:
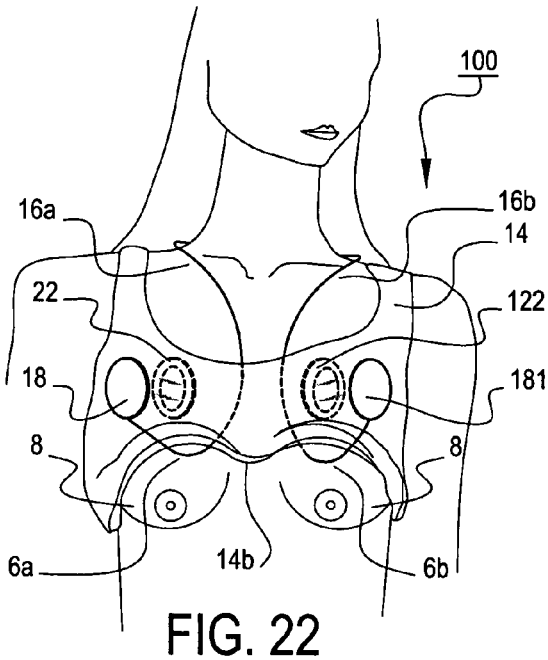
FIG. 22 shows the multiple magnet assembly employing the under and over method for securing being separated and aligned for use in accordance with this invention.

FIG. 22 shows the multiple magnet assembly 100 of FIG. 20 in operation employing an "under and over" method of use for securing the garment 14 above the breasts 8 of the user. As shown, the first and second faceplates 18, 181 attached to the first and second cord portions 16*a*, 16*b*, respectively. The first and second faceplates 18, 181 are then tucked back through the neckline 14*a* of the garment 14, down along the back side of the garment 14, and back up under the bottom edge 14*b* of the garment 14 and brought to rest at a predetermined position above the breasts 8 so that the breasts 8 may be exposed in order to nurse the infants. The first and second rear plates 22, 122 are positioned behind the garment 14 at positions opposite the first and second faceplates 18, 181 respectively.

Figure 23:
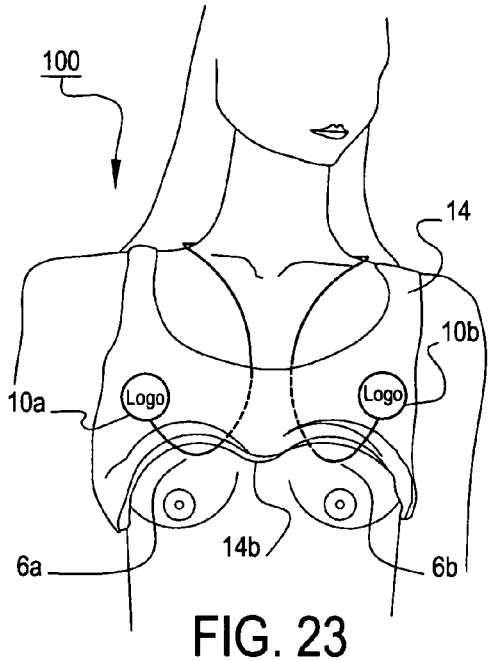
FIG. 23 shows the multiple magnet assembly being secured in place using the under and over method for alignment in accordance with this invention.

FIG. 23 illustrates a magnetically closed position in which a magnetic force is created in the various first magnetic elements 20*a* and the various second magnetic elements 20*b* to bias the first magnetic securing device assembly 10*a* and the second magnetic securing device assembly 10*b* closed. In use, the first magnetic securing device assembly 10*a* and the second magnetic securing device assembly 10*b* secure the garment 14 in position over the breasts 8 of the user during nursing.

Figure 24:
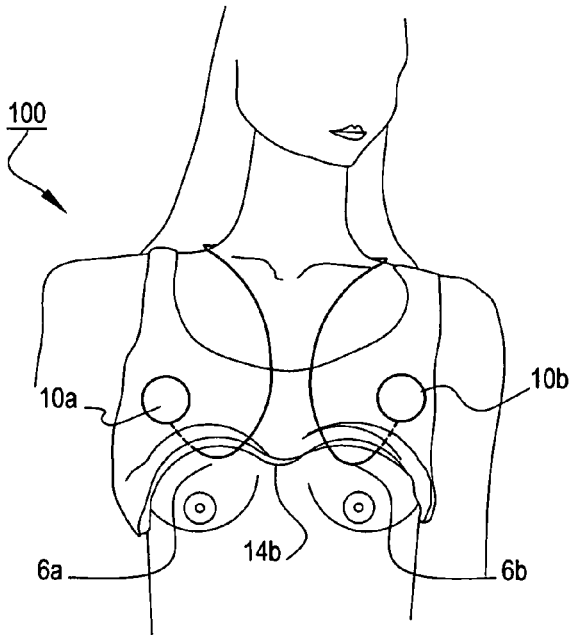
FIG. 24 shows the multiple magnet assembly being secured in place using the over and under method for alignment in accordance with this invention.

As shown in FIGS. 22-24, the lower end of the garment 14*b* is secured by the tethered hooks 6*a*, 6*b* over each breast 8. The tethered hooks 6*a*, 6*b* hold the garment 14 up at a predetermined height positioned by the user over the breasts 8. The height of the garment 14 disposed above the breasts 8 can be adjusted based on the position of the magnetic securing device assembly 10*a* and the magnetic securing device assembly 10*b* on the garment 14.

FIG. 24 shows the first magnetic securing device assembly 10*a* and the second magnetic securing device assembly 10*b* of the multiple magnet assembly 100 in an alternative closed position. The multiple magnet assembly 100 shown herein incorporates an "over and under" method of use for securing the garment 14 over the breasts 8 of the user.

The first and second faceplates 18, 181 have been tucked back upward along the back side of the garment 14 up to a predetermined height above the breasts 8 so that the breasts 8 may be exposed for nursing. The first and second rear plates 22, 122 are positioned and secured over the garment 14 at positions opposite the first and second faceplates 18, 181 respectively. A magnetic force is created that biases the respective first magnetic elements 20*a* and the second magnetic elements 20*b* closed to secure the garment 14 in position above the breasts 8 during nursing.

Figure 25:
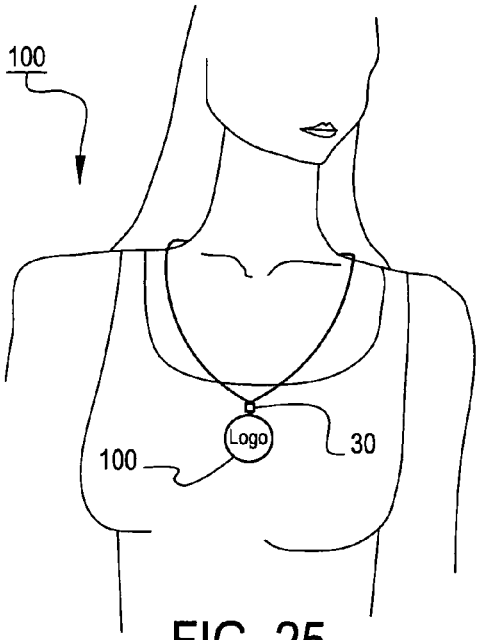
FIG. 25 illustrates another exemplary view of a multiple magnetic securing device assembly including an alignment bead for use with a cord in accordance with this invention.

FIG. 25 illustrates an exemplary embodiment for another variation of the magnetic securing device 10 embodied as a multiple magnet assembly 100 including an alignment bead 30 in accordance with this invention. As shown, the first magnetic securing device assembly 10*a* and the second magnetic securing device assembly 10*b* are positioned in a closed, overlapping configuration as an ornament necklace. The alignment bead 30 is adjustable along the cord 16 and adapted to individually align and cinch the first cord portion 16*a* and the second cord portion 16*b* at various locations in order to assist the user in positioning the garment 14 over their breasts 8 during use.

Figure 26:
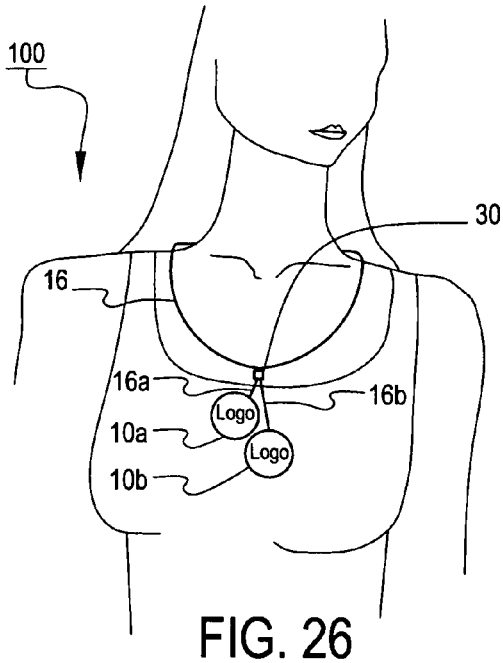
FIG. 26 shows another configuration in which the multiple magnetic securing device assembly may be worn as a necklace assembly in accordance with this invention.

FIG. 25 shows the multiple magnetic securing device assembly 100 being partially disconnected, albeit individually closed and skewed configuration. FIG. 26 demonstrates the alignment bead 30 being used to adjust the overall length of the cord 16 by manipulating the lengths of the first and second cord portions 16*a*, 16*b*. The first cord portion 16*a* is shown having a first length and attached to the first magnetic securing device assembly 10*a*, and the second cord portion 16*b* is shown having a second length and attached to the second magnetic securing device assembly 10*b*. The lengths of the various first and second cord portions 16*a*, 16*b* are adjusted by manipulation of the alignment bead 30. In FIG. 26, the first and second cord portions 16*a*, 16*b* are purposely offset to demonstrate the use of the multiple magnetic securing device assembly as an aesthetic multiple-piece of jewelry, as well as for it functional purpose of securing a garment over the breast of a nursing mother. It is to be understood that the magnetic securing device assembly of this invention may be worn in a variety of different ways as various types aesthetic ornamental pieces of jewelry in accordance with this invention.

Figure 27:
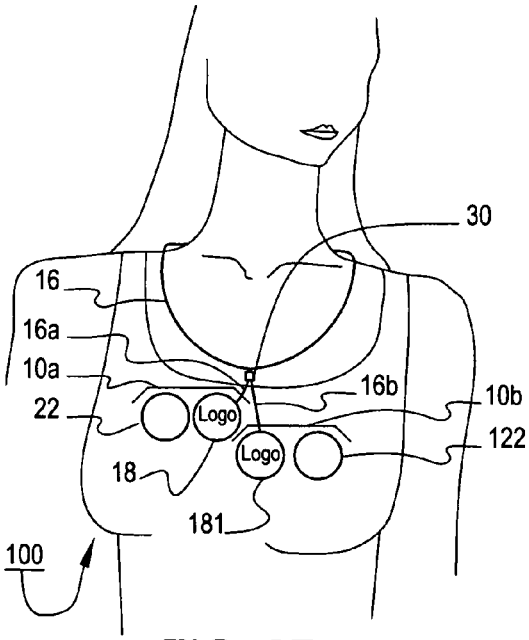
FIG. 27 depicts the multiple magnetic securing device separated for use in which the cord is attached to the faceplate in accordance with this invention.

FIG. 27 shows the multiple magnet assembly 100 including a pair of magnetic securing devices assemblies 10*a*, 10*b* coupled to the alignment bead 30 and separated in an offset open configuration. The multiple magnet assembly 100 shown herein FIGS. 27-28 function similar to the multiple magnet assembly 100 shown in FIGS. 20-21. The addition here being the alignment bead 30 capable of further adjustment while in use as a garment 14 securing magnetic securing device assembly.

FIG. 27 further shows the multiple magnet assembly 100 secured by the alignment bead 30 and in an open configuration in which the first magnetic securing device assembly 10*a* is separated from the second magnetic securing device assembly 10*b*.

As before, the first magnetic securing device assembly 10*a* includes a first faceplate 18 having a first magnetic element 20*a* (as shown in FIG. 2) recessed therein and attached to a first cord portion 16*a*. The first magnetic securing device assembly 10*a* also includes a rear plate 22 having a recessed second magnetic element 20*b* (as shown in FIG. 2).

The second magnetic securing device assembly 10*b* of the multiple magnetic securing device assembly 100 includes a includes a second faceplate 181 having a first magnetic element 20*a* (as shown in FIG. 2) recessed therein and attached to a second cord portion 16*b*. The second magnetic securing device assembly 10*b* also includes a second rear plate 122 having a recessed second magnetic element 20*b*.

Figure 28:
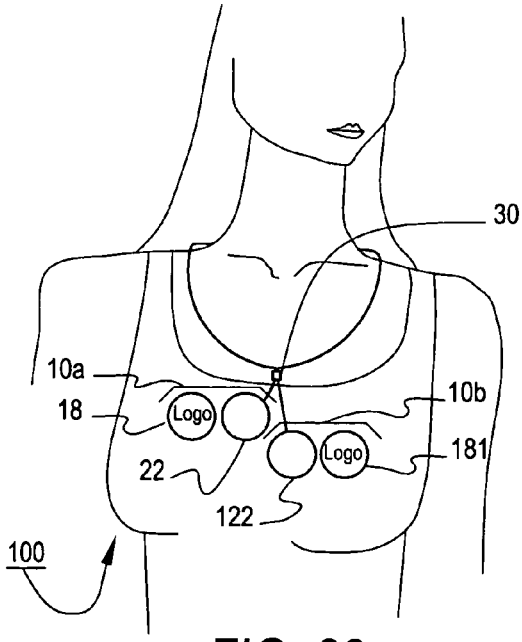
FIG. 28 shows another variant in which the multiple magnetic securing device is separated for use in which the cord is attached to the rear plate in accordance with this invention.

FIG. 28 shows an alternative construction in which the rear plate 22 and the rear plate 122 are securely attached to the first cord portion 16*a* and the second cord portion 16*b* respectively. The multiple magnet assembly 100 shown in FIG. 28 functions similar to the multiple magnet assembly 100 shown in FIG. 27.

The advantage of including the alignment bead 30 is the user's ability to more easily manipulate the height at which each of the individual first magnetic securing device assembly 10*a* and second magnetic securing device assembly 10*a* may be positioned to draw the garment higher or lower over each of the breasts 8 individually.

Figure 29:
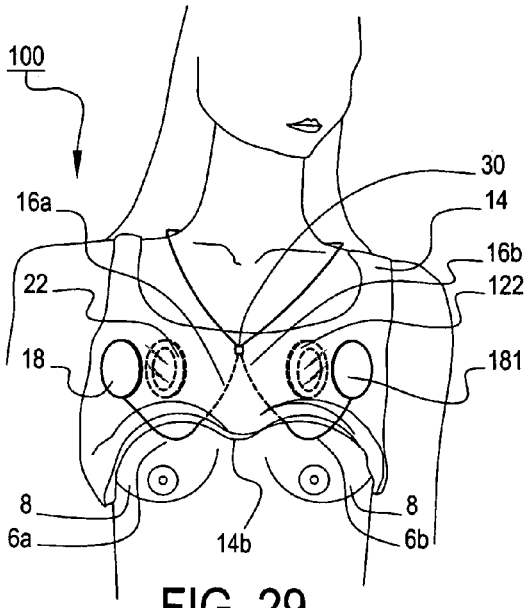
FIG. 29 shows a multiple magnet assembly separated and aligned for use with an alignment bead for use with a cord employing an under and over method for attachment in accordance with this invention.

FIG. 29 shows the multiple magnet assembly 100 employing an "under and over" technique for securing the garment 14 over the breasts 8 of the user. As shown, the first and second faceplates 18, 181 are attached to the first and second cord portions 16*a*, 16*b*, respectively, each being tucked backward through the neckline 14*a* of the garment 14, down along the back side of the garment 14, and back up under the bottom edge 14*b* of the garment 14 and brought to rest at a predetermined position above the breasts 8 so that the breasts 8 may be exposed for nursing.

In use, the alignment bead 30 is a mechanism for adjusting the height of the first and second magnetic securing device assemblies 10*a*, 10*b* at a user preferred predetermined height on the garment 14. The alignment bead 30 is adapted to tighten or loosen the slack in the first and second cord portions 16*a*, 16*b*, which in turn shortens or lengthens the overall length of the cord 16 while in use.

The first and second rear plates 22, 122 are positioned behind the garment 14 at positions opposite the first and second faceplates 18, 181, respectively. If the user desires to shorten or length the overall length of the cord 16 to raise or lower the lower edge 14*b* of the garment 14 over the breast 8 respectively, the user may easily adjust the position of the alignment bead 30 by raising or lowing the position of the alignment bead 30 along the cord 16 instead of repositioning the first and second magnetic securing device assemblies 10*a*, 10*b*.

Figure 30:
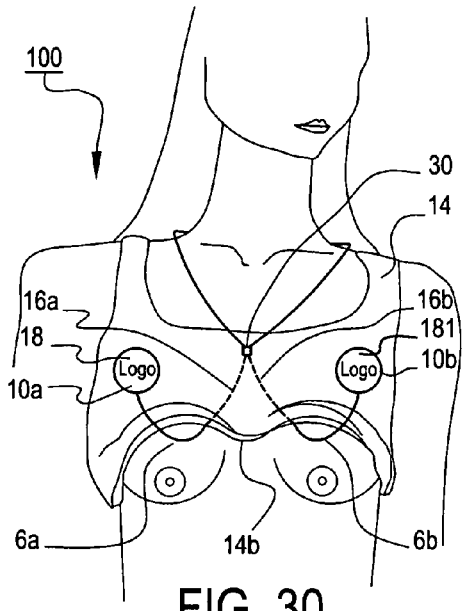
FIG. 30 shows the multiple magnet assembly aligned and secured in use by employing the under and over method for securing in accordance with this invention.

FIG. 30 shows a secure position in which a magnetic force is created that biases the first magnetic element 20*a* and the second magnetic element 20*b* in the first magnetic securing device assembly 10*a* closed. Likewise, another magnetic attraction force is created in the second magnetic securing device assembly 10*b* that biases the first magnetic element 20*a* in the second faceplate 181 and the second magnetic element 20*b* in the second rear plate 122 closed to secure the garment 14 in position above the breasts 8 during nursing.

Figure 31:
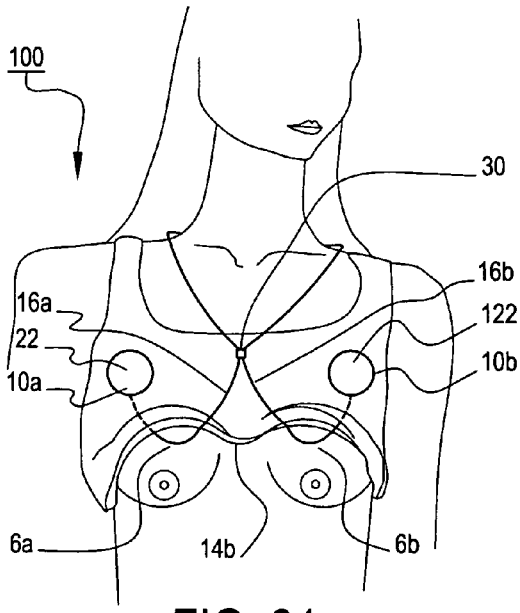
FIG. 31 shows a multiple magnet assembly aligned and secured employing an over and under method for attachment in accordance with this invention.
Figure 44:
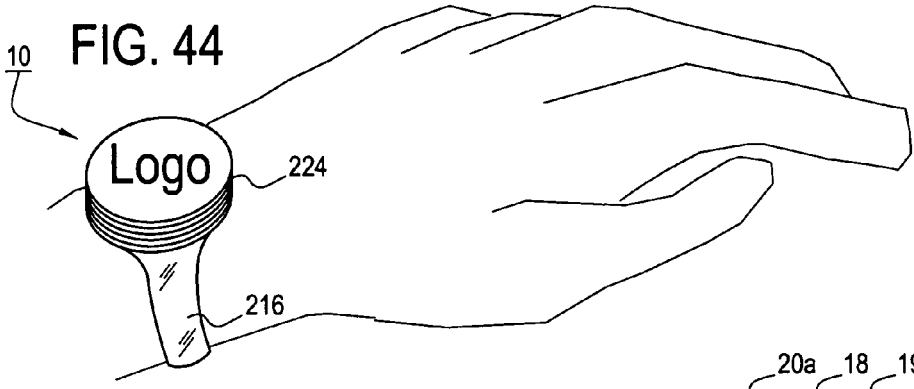
FIG. 44 is an exemplary perspective illustration of a magnetic securing device assembly employing a multi magnet arrangement worn as the bracelet in accordance with this invention.

FIG. 31 shows the first magnetic securing device assembly 10*a* and the second magnetic securing device assembly 10*b* arranged in a closed position depicting an "over and under" method of use for securing the garment 14 over the breasts 8 of the user. The first and second faceplates 18, 181 are tucked back upward along the back side of the garment 14 up to a predetermined height above the breasts 8 so that the breasts 8 may be exposed for nursing infants. As shown, the first and second rear plates 22, 122 are separated, re-positioned and secured over the garment 14 at positions opposite the first and second faceplates 18, 181 respectively.

The alignment bead 30 is suitably adjusted to tighten the slack in the first and second cord portions 16*a*, 16*b* of the cord 16 in order to optimally position the garment above the breasts 8 as desired by the user. If the user desires to shorten or lengthen the overall length of the cord 16 in order to raise or lower the garment 14 over the breasts 8, the user may easily adjust the position of the alignment bead 30 by raising or lowering the bead 30 instead of repositioning the first and second magnetic securing device assemblies 10*a*, 10*b*.

A magnetic force is created that biases the first magnetic element 20*a* and the second magnetic element 20*b* closed within the first magnetic securing device assembly 10*a*. Likewise, another magnetic force is created that biases the first magnetic element 20*a* and the second magnetic element 20*b* closed within the second magnetic securing device assembly 10*b* to secure the garment 14 in position above the breasts 8 during nursing.

The tethered hooks 6*a*, 6*b* hold the lower end 14*b* of the garment 14 up at a predetermined height above the breasts 8. The height of the lower end 14*b* of the garment 14 can be varied based on adjustment of the alignment bead 30 and the adjustable position of the first and second magnetic securing device assemblies 10*a*, 10*b* on the garment 14.

FIG. 32 is an exemplary illustration of the magnetic securing device assembly 10 worn as a pendant 112 without the cord 16 in accordance with this invention. In use, the pendant 112 is also used as a garment securing mechanism adapted to secure an upper garment 14 away from the user's breast 8 when she nurses an infant.

FIG. 33 depicts a cross section view of the pendant 112 and FIG. 34 depicts a side view of the pendant 112 in accordance with this invention. As shown, the pendant 112 includes a faceplate 18 having a recess 19*a*, a retaining loop 17 for capturing a cord 16 when worn as a necklace 12, a first magnetic element 20*a* and a second magnetic element 20*b* recessed within the rear plate 22 and disposed on opposite sides of various layers of the garment 14.

The first magnetic element 20*a* is shown disposed in the recess 19*a* of the faceplate 18 so that the outer surface of the first magnetic element 20*a* is substantially flush with the rear side 18*b* of the faceplate 18. A second magnetic element 20*b* disposed within the rear plate 22 is provided opposite the first magnetic element 20*a*, and various folds of the garment 14 are illustrated by a plurality of garment layers 13 disposed between the first magnetic element 20*a* and the second magnetic element 20*b*.

In use, when nursing an infant, the garment 14 is pulled upward and bunched up over the top of the breast 8. The first magnetic element 20*a* is aligned over the various garment layers 13 at a predetermined height as desired by the user. The second magnetic element 20*b* is positioned just behind the garment 14, opposite the position of the first magnetic element 20*a*, and a magnetic attraction force allows the first magnetic element 20*a* and the second magnetic element 20*b* to compress the garment layers 13 and hold the various layers 13 of the garment 14 at the predetermined position as shown in FIG. 32. The pendant 112 may be conveniently stored and worn, when not in use, on the garment 14, as a decorative pendant.

FIGS. 35 and 36 show a reverse construction for the pendant 112 construction in which the retaining loop 17 is disposed on the second magnetic element 20*b*. The first magnetic element 20*a* and the second magnetic element 20*b* of the pendant 112 shown in FIGS. 35-36 operate similar to the pendant 112 described above in FIGS. 33-34.

FIGS. 37 and 38 illustrate an exemplary exploded view and an assembled perspective view of a magnetic securing device assembly 10 worn as a decorative bracelet 214 in accordance with this invention.

As shown in the cross section and side views shown in FIGS. 39-40, the magnetic securing device assembly 10 includes a faceplate 18 having a recess 19 into which a first magnetic element 20*a* may be disposed. The magnetic securing device assembly 10 may include a second magnetic element 20*b* (such as shown in FIG. 2) disposed between the first magnetic element 20*a* and a base 223 of the bracelet 214 and the second magnetic element 20*b*. In the alternative, and shown here, the rear plate 22 is made of a magnetic element and includes the magnetic properties to secure the rear plate 22 to the base 223 and to the first magnetic element 20*a*. The magnetic securing device assembly 10 is carried on the wrist of the user by an adjustable band 216. In FIGS. 39-42, a retaining loop 17 is shown disposed on the faceplate 18 of the magnetic securing device assembly 10 so that the magnetic securing device assembly 10 may be separated from the bracelet 216 on occasion and worn ad a necklace 12 as described above.

In use, the magnetic securing device assembly 10 may be used similar to that of the pendant 112 shown and described in FIGS. 32-36. FIG. 38 shows the magnetic securing device assembly 10 being attached by an adjustable band 216 and worn as a decorative bracelet 214 around a user's wrist.

As mentioned before, an object of this invention is to be able to interchangeably wear the magnetic securing device assembly 10 with various ornamental accessories. As such, when the magnetic securing device assembly 10 is to be worn as a necklace, a cord 16 may be laced through the retaining loop 17 disposed on the faceplate 18 as shown in FIGS. 39-40. Alternatively, the retaining hole 17 may be disposed on the rear plate 22 as shown in FIGS. 41-42 for use as a necklace. As mentioned previously, the faceplate 18 may include a decorative element, a logo, a design and/or some other type of indicia.

Figure 46:
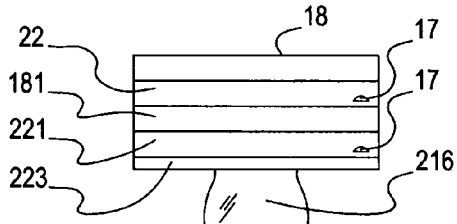
FIG. 46 depicts a side view of the magnetic securing device assembly shown in FIG. 45 in accordance with this invention.
Figure 43:
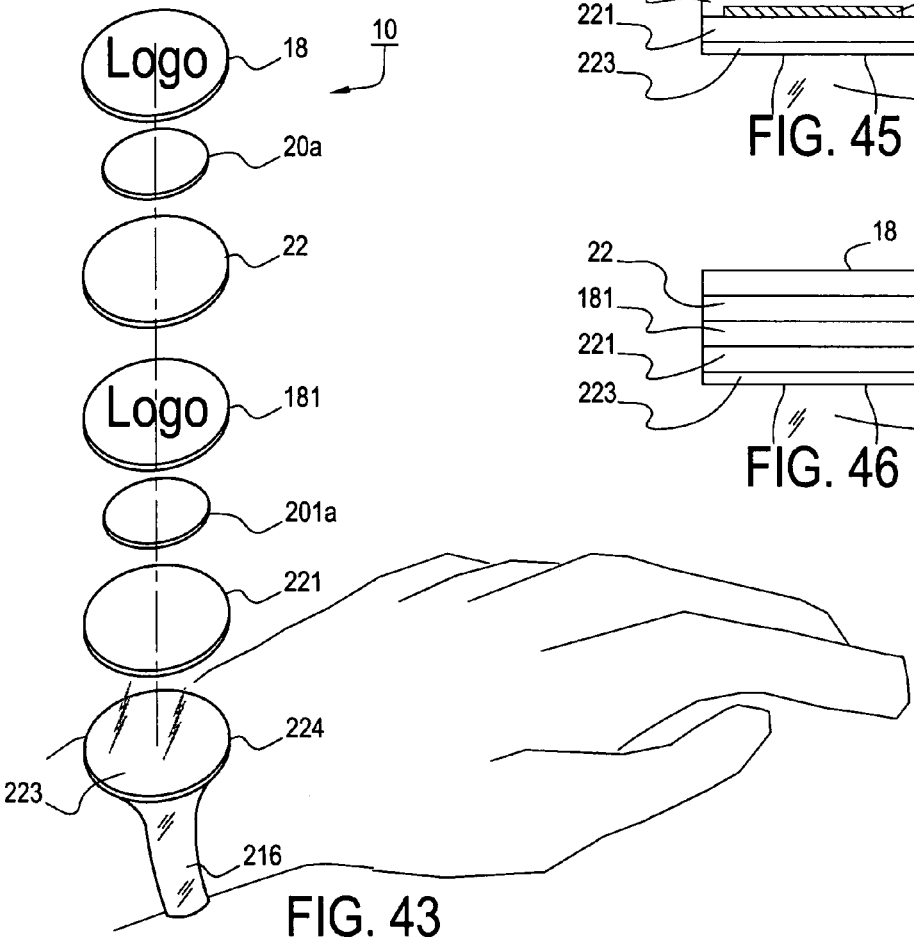
FIG. 43 is an exploded view of the magnetic securing device assembly employing the multi magnet arrangement embodied as a bracelet in accordance with this invention.

FIGS. 43 and 46 illustrate yet another exemplary exploded view and an assembled perspective view of a magnetic securing device assembly 10 worn as a decorative bracelet 224 in accordance with this invention. According to this embodiment, the multiple magnet assembly of the magnetic securing device assembly 10 may be employed by a nursing mother who would have a need to frequently feed two infants at the same time. As discussed above, the dual magnet construction may be beneficial to a mother with twins.

Figure 45:
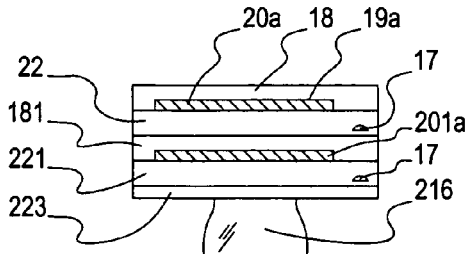
FIG. 45 depicts a cross section view of the magnetic securing device assembly embodied as a bracelet including various retaining loops in a rear plate in accordance with this invention.

As shown in the cross section and side views shown in FIGS. 45-46, the magnetic securing device assembly 10 includes a faceplate 18 having a recess 19 into which a first magnetic element 20*a* may be disposed. A second and third magnetic elements 20*b* may be disposed in the rear plate 22 between the first magnetic element 20*a* and a second faceplate 181, and between another magnetic element 20*a* and the base 223. Another pair of magnetic elements 201, 221 may also be disposed between the second faceplate 181 and rear plate 221 on the bracelet 214.

The magnetic securing device assembly 10 is carried on the wrist of the user by the adjustable band 216. In FIGS. 45-46, various retaining loops 17 are shown disposed on the first faceplate 18 and the second faceplate 218 of the magnetic securing device assembly 10. The retaining holes 17 may be interchangeably disposed through the second magnetic element 20*b* and the rear plate 221 so that when the magnetic securing device assembly 10 is to be worn as a necklace 12, a cord 16 may be laced through the retaining holes 17 disposed on the rear plates 22, 221 for use with, for example, the embodiment shown in FIGS. 19-32.

Figure 47:
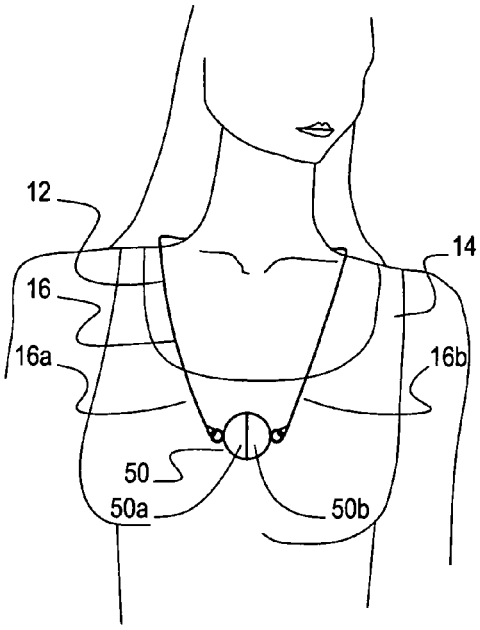
FIG. 47 is an exemplary illustration of a magnetic securing device assembly constructed as a first portion and a second portion being worn as a necklace having a cord attached to both elements in accordance with this invention.

FIG. 47 is an exemplary illustration of another magnetic securing device assembly 50 worn as a necklace 12 in accordance with this invention. As an everyday use necklace, the magnetic securing device assembly 50 may be worn as an aesthetic emulate or the like. The magnetic securing device assembly 50 includes a first magnetic element 50*a* and a second magnetic element 50*b*.

Figure 48:
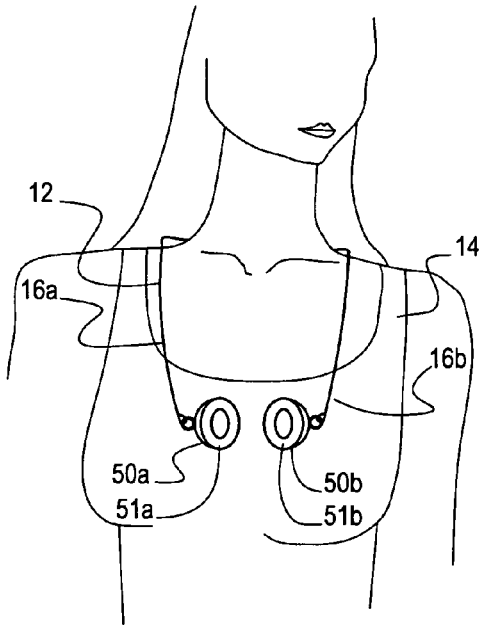
FIG. 48 shows the first portion and the second portion of the magnetic securing device assembly separated in accordance with this invention.

FIG. 48 shows the first magnetic element 50*a* and the second magnetic element 50*b* being separated. The magnetic securing device assembly 50 is separable at a mating junction 51.

Figure 49:
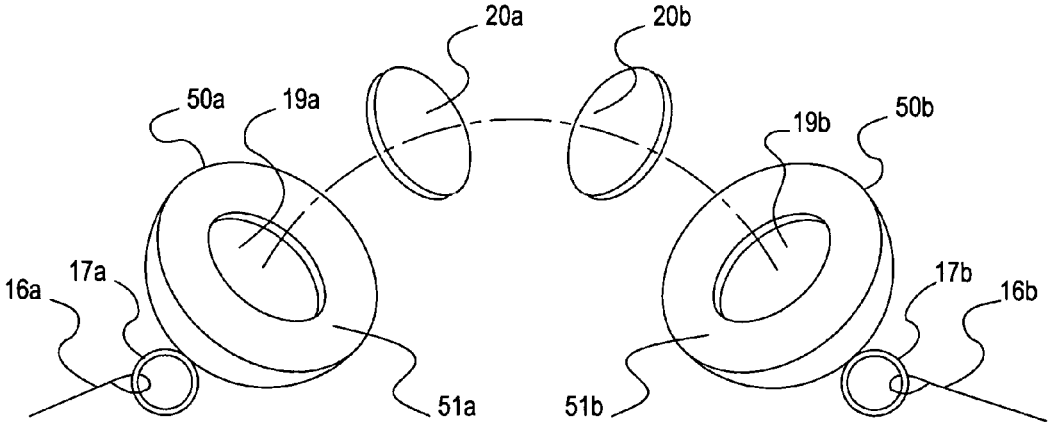
FIG. 49 illustrates an exploded view of the first portion and the second portion of the magnetic securing device assembly in accordance with this invention.

FIG. 49 depicts an exploded view of the magnetic securing device assembly 50. The first magnetic element 50*a* of the magnetic securing device assembly 50 includes a first recess 19*a* for receiving a first magnetic element 20*a*. A first retaining loop 17*a* is attached to the first magnetic element 50*a* at a first end and a first cord portion 16*a* at a second end.

Likewise, the second magnetic element 50*b* of the magnetic securing device assembly 50 includes a second recess 19*b* for receiving a second magnetic element 20*b*. A second retaining loop 17*b* is attached to the second magnetic element 50*b* at a first end and a second cord portion 16*b* at a second end.

As shown in FIG. 47, the cord 16 is worn around the neck of the user as a necklace 12. The first cord portion 16*a* is disposed at a first end of the cord 16 and attached to the first magnetic element 50*a* through the first retaining loop 17*a*, and the second cord portion 16*b* is disposed at the other end of the cord 16 being attached to the second magnetic element 50*b* through the second retaining loop 17*b*.

As before, the magnetic securing device assembly 50 may be decoratively constructed and may include a logo, a design and/or some other type of indicia. Jewels or other precious metal items may be incorporated into the aesthetic design of the magnetic securing device assembly 50. Various types of decorative designs may be constructed thereon. The magnetic securing device assembly 50 may be constructed of an endless array of shapes, sizes, colors and other designs may be included as part of the magnetic securing device assembly 50 without interfering with the functionality of the device. The various designs on the first magnetic element 50*a* and the second magnetic element 50*b* may be interchanged with one another without inhibiting the functionality of the overall device.

Although various circular retaining loops 17, 17*a*, 17*b* are shown, it is to be understood that the retaining member may vary in design, and construction suitable for securing the cord 16 to the magnetic securing device assembly 50.

Figure 50:
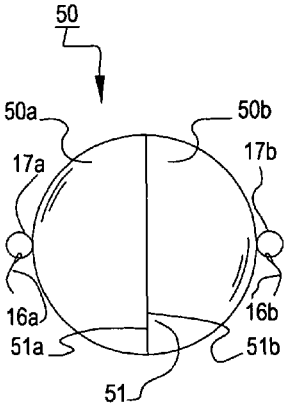
FIG. 50 is a close up view of the first portion and the second portion of the magnetic securing device assembly magnetically assembled together in accordance with this invention.

FIG. 50 is a close up view of the magnetic securing device assembly 50. As shown, the mating junction 51 includes a first mating surface 51*a* on the first magnetic element 50*a*, and a second mating surface 51*b* on the second magnetic element 50*b*.

Figure 51:
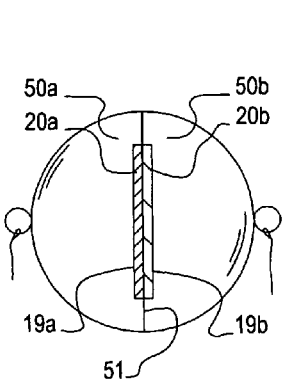
FIG. 51 is a partial cross section view of the first portion and the second portion of the magnetic securing device assembly magnetically assembled together in accordance with this invention.

FIG. 51 is a partial cross section view of the first magnetic element 50*a* and the second magnetic element 50*b* of the magnetic securing device assembly 50. The first magnetic element 20*a* is shown disposed within the first recess 19*a*, and the second magnetic element 20*b* is shown disposed within the second recess 19*b*. In this closed configuration, the first mating surface 51*a* on the first magnetic element 50*a*, and the second mating surface 51*b* on the second magnetic element 50*b* sit flush against each other in order to maximize the magnetic attraction between the first magnetic element 20*a* and the second magnetic element 20*b*.

It is to be understood that various adhesive materials and/or processes may be employed to secure the first and second magnets 20*a*, 20*b* to the first magnetic element 50*a* and second magnetic element 50*b* respectively. For example, the magnets may be attached by an epoxy, a resin, a weld, fusing and/or any other suitable process for securing the magnets to the first magnetic securing device assembly portions.

Figure 52:
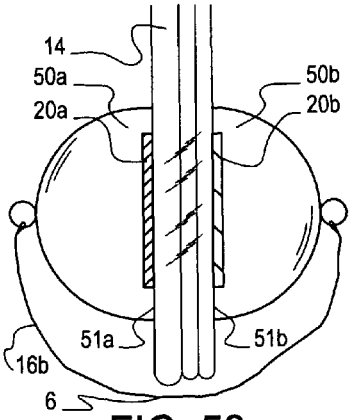
FIG. 52 is a partial cross section view of the magnetic securing device assembly placed on opposite ends of a garment and being magnetically secured together in accordance with this invention.

FIG. 52 is a partial cross section view of the magnetic securing device assembly 50 placed on opposite sides of a garment 14 and being magnetically secured together to hold the garment in a predetermined position. As shown, the cord 16 is positioned about the garment 14 so that a tethered hook 6 is formed at the bottom of the cord 16 below the garment in order to secure the garment 14 in place.

Figure 53:
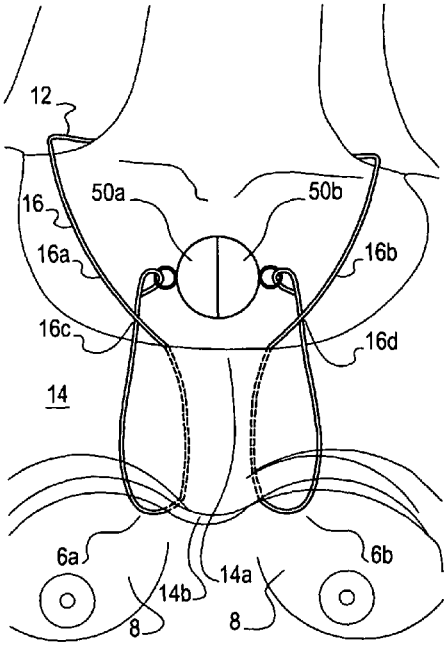
FIG. 53 illustrates an exemplary method for securing the magnetic securing device assembly around a garment by employing an under and over technique in accordance with this invention as shown in FIG. 51.

FIG. 53 illustrates an exemplary method for securing the magnetic securing device assembly 50 around a garment 14 in accordance with this invention. In particular, FIG. 53 shows operation of an "under and over" method of use for securing the garment 14 above the breast 8 of the user. As shown, the magnetic securing device assembly 50 is first tucked back through the neckline 14*a* of the garment 14, down along the back side of the garment 14, and then forward back up under the bottom edge 14*b* of the garment 14 and pulled back upward to a location above the neckline 14*a* of the garment 14.

The first magnetic element 50*a* may then be separated from the second magnetic element 50*b*. The first magnetic element 50*a* is slid back under the first cord portion 16*a* (at approximately cord location 16*c*) and the second magnetic element 50*b* is also slid back under the second cord portion 16*b* (at approximately cord location 16*d*). Both, the first magnetic element 50*a* and second magnetic element 50*b* are then magnetically reconnected thereby securing the garment 14 at a predetermined position above the breasts 8 so that the breast 8 may be exposed so that, for example, a nursing mother can nurse an infant as shown in FIG. 53.

FIG. 53 illustrates a closed position in which a magnetic force is created between the first magnetic element 20*a* and the second magnetic element 20*b* that biases the first magnetic element 20*a* and the second magnetic element 20*b* into a closed, locked position. As shown in FIG. 53, a pair of tethered hooks 6*a*, 6*b* are formed by the cord 16 just under the lowermost portion 14*b* of the garment 14. The tethered hooks 6*a*, 6*b* holds the lowermost portion 14*b* of the garment 14 up at a predetermined height above the breasts 8. In a variety of different ways, the height of the garment 14 may be adjustably raised or lowered above the breasts 8 by the use of the magnetic securing device assembly 50. For example, the first magnetic element 50*a* and the second magnetic element 50*b* may be encircled a number of times around the cord 16, or the garment 14, and then secured to each other to obtain a desired height. Likewise, an adjustable bead 30 (as shown in FIGS. 25-34 and described above) may be incorporated into the magnetic securing device assembly 50 to provide the adjustment.

Figure 54:
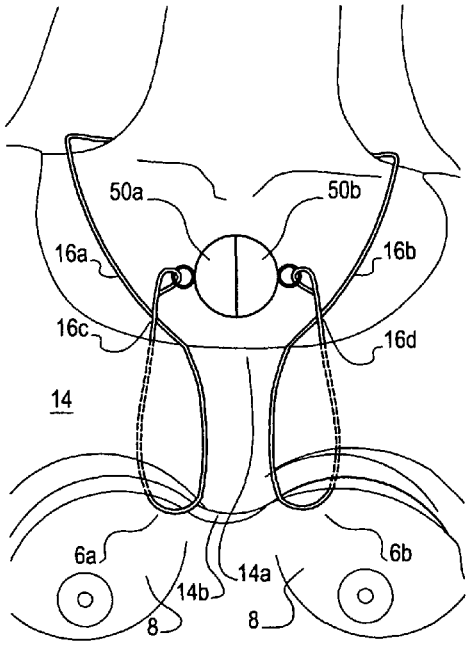
FIG. 54 illustrates another exemplary method for securing the magnetic securing device assembly in an opposite direction around a garment by employing an over and under technique in accordance with this invention as shown in FIG. 51.

FIG. 54 illustrates another exemplary method for securing the magnetic securing device assembly 50 in an opposite direction around the garment 14 in accordance with this invention. As shown in this configuration, the magnetic securing device assembly 50 employs an "over and under" method for securing the garment 14 over the breasts 8 of the user. As such, from a hanging position, the magnetic securing device assembly 50 is tucked back up under the garment 14 from front to back, and upward along the back side of the garment 14 to a predetermined height above the breasts 8 so that the breasts 8 may be exposed for nursing.

The first magnetic element 50*a* may then be separated from the second magnetic element 50*b*. The first magnetic element 50*a* is slid out over the top of the first cord portion 16*a* (at approximately cord location 16*c*), and the second magnetic element 50*b* is also slid out over the top of the second cord portion 16*b* (at approximately cord location 16*d*). Both, the first magnetic element 50*a* and second magnetic element 50*b* are then magnetically reconnected thereby securing the garment 14 at a predetermined position above the breasts 8 so that the breast 8 may be exposed in order to nurse an infant as shown in FIG. 54. A magnetic force is created that biases the first magnetic element 20*a* and the second magnetic element 20*b* closed.

FIG. 55 is a close up view of another construction for the magnetic securing device assembly 50. Similar in feature and functionality to the magnetic securing device assembly 50 described in FIGS. 50-54. It is to be understood that the magnetic securing device assembly 50 may be constructed in a variety of different ways. For example, the magnetic securing device assembly 50 shown in FIG. 55 includes a first retaining loop 17*a* attached to the first magnetic element 50*a* at a first location adjacent to the mating junction 51, and a second retaining loop 17*b* is attached to the second magnetic element 50*b* at an opposite second location adjacent to the mating junction 51.

FIG. 56 is a partial cross section view of the first magnetic element 50*a* and the second magnetic element 50*b* of the magnetic securing device assembly 50. The first magnetic element 20*a* is shown disposed within the first recess 19*a*, and the second magnetic element 20*b* is shown disposed within the second recess 19*b*. As shown in this closed configuration, the first mating surface 51*a* on the first magnetic element 50*a*, and the second mating surface 51*b* on the second magnetic element 50*b* sit flush against each other in order to maximize the magnetic attraction between the first magnetic element 20*a* and the second magnetic element 20*b*.

In the closed position shown in FIG. 56, the force required to overcome the magnetic attraction force securing the first magnetic element 50*a* and the second magnetic element 50*b* together is a lateral, shear force that would follow in the direction of the first cord portion 16*a* and the direction of the second cord portion 16*b*. That is, the increased surface area at the mating junction 51 must be overcome by a sufficient lateral shear force capable of magnetically decoupling the first magnetic element 50*a* from the second magnetic element 50*b* in accordance with this invention.

FIG. 57 is a partial cross section view of the magnetic securing device assembly 50 placed on opposite sides of a garment 14. The first magnetic element 50*a* and the second magnetic element 50*b* are magnetically attracted to each other with a sufficient force in order to secure the garment 14 in a predetermined position. As shown, the second cord portion 16*b* is positioned over the garment 14 so that a tethered hook 6 is formed at the bottom of the cord 16 in order to secure the garment 14 in place, as shown in FIGS. 58 and 59.

FIG. 58 illustrates an exemplary method for securing the magnetic securing device assembly 50 around a garment 14 in accordance with this invention. In particular, FIG. 58 shows operation of an "under and over" method of use for securing the garment 14 above the breast 8 of the user. As shown, the second magnetic element 50*b* is disconnected from the first magnetic element 50*a* and the second magnetic element 50*b* is first tucked back, from front to back, under the lowermost edge 14*b* of the garment 14, and upward along the back side of the garment 14 to a predetermined height above the breasts 8, and behind the garment 14 so that the breasts 8 may be exposed for nursing. The first magnetic element 50*a* is positioned over the garment 14, and adjacent to, a location opposite the second magnetic element 50*b* behind the garment 14. The first magnetic element 50*a* and the second magnetic element 50*b* are then permitted to be secured to each other under the magnetic attraction force of the first and second magnets 19*a*, 19*b*. The magnetic securing device assembly 50 may be adjusted to vary the height of the lowermost side 14*b* of the garment 14 at a predetermined position above the breasts 8 so that a nursing mother can be prepared to nurse an infant as shown in FIG. 58.

FIG. 59 shows that the magnetic securing device assembly 50 may be used in a variety of different manners. As shown in this configuration, the magnetic securing device assembly 50 further employs the "over and under" method described in FIG. 58 above, the difference being that the first magnetic element 50*a* and the second magnetic element 50*b* may be connected anywhere around the neck of the user. Here, the magnetic securing device assembly 50 is not disposed over the garment 14. As shown, both halves of the magnetic securing device assembly 50 are connected above the neckline and/or uppermost edge 14*a* of the garment 14.

As in FIG. 60, it is understood that the magnetic securing device assembly 50 may be constructed in a variety of different sizes and shapes. The construction shown in FIG. 60 is one in which the first magnetic element 50*a* and the second magnetic element 50*b* are constructed like a pair of flat coins arranged face to face with each other. The magnetic securing device assembly 50 shown in FIG. 60 can perform similar to the features and functionality discussed with respect to the magnetic securing device assembly 50 shown and described in FIGS. magnetic securing device assembly 50-59.

FIG. 61 is another exemplary illustration of a magnetic securing device assembly 50 being worn as a bracelet over the wrist of a user in accordance with this invention. The construction is similar in feature and functionality to the magnetic securing device assembly 50 shown and described in FIGS. 50-52.

FIGS. 62-64 illustrate a close up view, and use for the magnetic securing device assembly 50. As shown in FIGS. 62-63, in use, the first magnetic element 50*a* is opened by being separated from the second magnetic element 50*b*. In use, the first magnetic element 50*a* along with the first cord portion 16*a* are fed up under the garment 14 to a position above the uppermost edge 14*a* of the neckline of the garment 14. The second magnetic element 50*b* along with the second cord portion 16*b* are fed over top the garment 14 to a position above the uppermost edge of the neckline of the garment 14 to a position opposite the first magnetic element 50*a*. The first magnetic element 50*a* and the second magnetic element 50*b* are allowed to magnetically fasten to each other in order to secure the lowermost end 14*b* of the garment 14 at a predetermined height suitable to uncover the breast 8 for nursing an infant, as shown in FIG. 63.

FIG. 64 illustrates another exemplary method for securing the magnetic securing device assembly 50 around a garment 14 in accordance with this invention. In use, the second magnetic element 50*b* is disconnected from the first magnetic element 50*a*. The first magnetic element 50*a*, along with the first cord portion 16*a*, are fed up under the garment 14 to a position just below the uppermost edge 14*a* of the neckline of the garment 14. The second magnetic element 50*b*, along with the second cord portion 16*b*, are fed over top the garment 14 to a position just below the uppermost edge of the neckline of the garment 14 to a position opposite the first magnetic element 50*a*. The first magnetic element 50*a* and the second magnetic element 50*b* are allowed to magnetically fasten to each other across the garment 14 in order to secure the lowermost end 14*b* of the garment 14 at a predetermined height suitable to uncover the breast 8 for nursing an infant, as shown in FIG. 64.

In both FIGS. 63-64, a tethered hook 6 is formed in the cord 16 that holds the lowermost edge 14*b* of the garment at a predetermined position above the breast 8 so that a breast feeding mother can nurse an infant.

Figure 65:
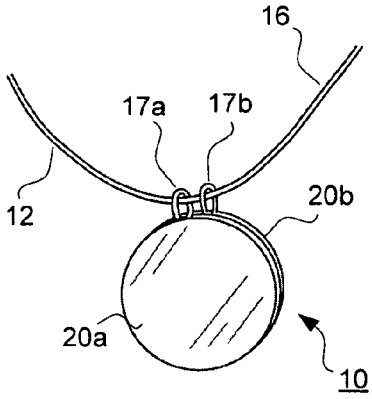
FIG. 65 is another exemplary illustration of a magnetic securing device assembly embodied as a necklace in accordance with this invention.

FIG. 65 is another exemplary illustration of a magnetic securing device assembly 10 embodied as a necklace 12. As an everyday use necklace, the magnetic securing device assembly 10 may be worn as an aesthetic emulate or the like. The magnetic securing device assembly 10 includes a first magnetic element 20*a* and a second magnetic element 20*b*.

The first magnetic element 20*a* of the magnetic securing device assembly 10 includes a first retaining loop 17*a* that is attached, and adapted, to slide along a cord 16. Likewise, the second magnetic element 20*b* of the magnetic securing device assembly 10 includes a second retaining loop 17*b* that is attached, and adapted, to slide is along the cord 16.

Figure 66:
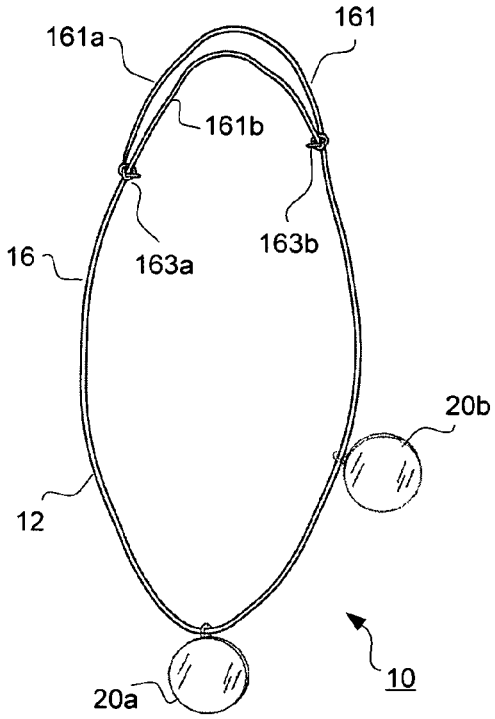
FIG. 66 depicts the magnetic securing device assembly separated and embodied as a necklace illustrating the adjustable cord in accordance with this invention.
Figure 67:
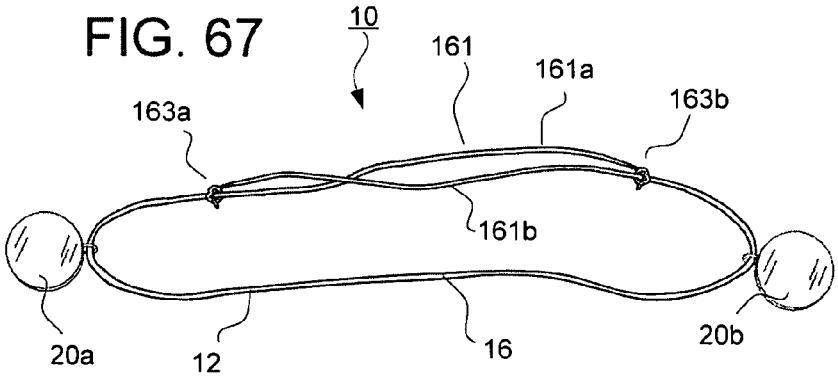
FIG. 67 shows the magnetic securing device assembly whose adjustable cord is further separated and extended in accordance with this invention.

FIGS. 66 and 67 depict the first magnetic element 20*a* being separated from the second magnetic element 20*b* along the cord 16. As shown in FIG. 66, the first magnetic element 20*a* is only slightly separated from the second magnetic element 20*b* along the cord 16. In FIG. 67, the first magnetic element 20*a* is substantially separated and disposed at an opposite end of the necklace 12 along the cord 16 of the magnetic securing device assembly 10.

FIGS. 66 and 67 further depict the cord 16 of the necklace 12 including an adjustment mechanism 161. The adjustment mechanism 161 of the necklace 12 includes a first end 161*a* of the cord 16 including a first adjustable portion. The first adjustable portion being a slip-knot 163*a* disposed at the first end 161*a* of the cord 16. Likewise, the adjustment mechanism 161 of the necklace 12 further includes a second end 161*b* of the cord 16 including a second adjustable portion. The second adjustable portion being a slip-knot 163*b* disposed at the second end 161*b* of the cord 16.

In use, the slip-knots 163*a*, 163*b* of the adjustment mechanism 161 are adapted to slide along the cord 16 in opposite directions to a predetermined position so that the ring of the necklace 12 measures a predetermined size. The necklace 12 may be resized to convert the necklace 12 into a bracelet 216*a* having a smaller circumference, as shown in FIG. 71.

Figure 68:
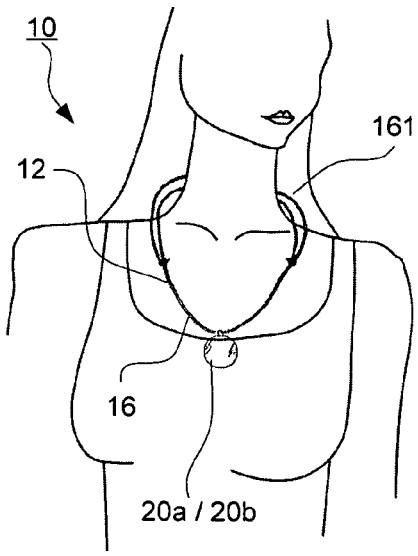
FIG. 68 illustrates the adjustable cord of the magnetic securing device contacted and worn as a short necklace in accordance with this invention.
Figure 69:
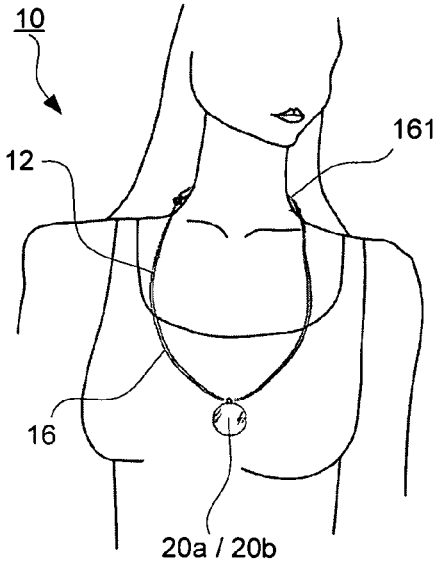
FIG. 69 shows the adjustable cord of the magnetic securing device extended and worn as a long necklace in accordance with this invention.
Figure 71:
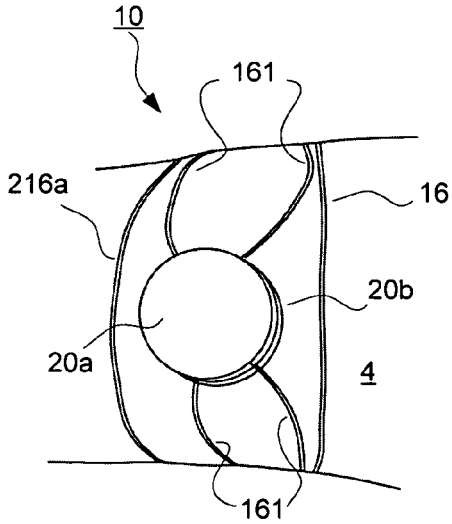
FIG. 71 depicts the magnetic securing device worn as a bracelet in accordance with this invention.

By way of example, FIGS. 68-69 and 71 depicts the cord 16 being adjusted and resized to accommodate various types of configurations. In FIG. 68, the adjustment mechanism 161 of the magnetic securing device assembly 10 is shown adjusted to form a smaller contracted internal circumference worn around the neck of a user thereby illustrating a smaller necklace 12. On the contrary in FIG. 69, the adjustment mechanism 161 of the magnetic securing device assembly 10 is shown adjusted to form a larger extended internal circumference worn around the neck of a user thereby rendering a larger necklace 12.

FIG. 71 demonstrates a further adaptation for the magnetic securing device assembly 10 in accordance with this invention. As shown, the necklace 12 has been fashionable resized and wrapped around a user's wrist 4 so that the magnetic securing device assembly 10 may be suitably worn as a bracelet 216*a*.

Figure 70:
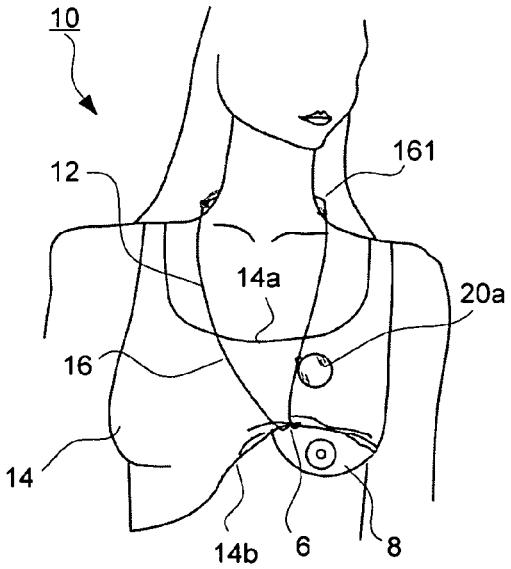
FIG. 70 illustrates the magnetic securing device assembly employing the over and under technique for securing a garment over a breast in accordance with this invention.

FIG. 70 illustrates a method for securing a garment 14 away from a breast 8 by employing the use of the magnetic securing device assembly 10. As shown, the magnetic securing device assembly 10 is worn as an ornamental piece of jewelry.

In use, a bottom edge 14*b* of the garment 14 is pulled up above the breast 8. A peripheral end of the adjustable cord 16 is tucked under the bottom edge 14*b* of the garment 14, and upward toward a neckline 14*a* of the garment 14 to a position above the breasts 8 so that the adjustable cord 16 forms a tethered hook 6 that holds the bottom edge 14*b* of the garment 14 above the breast 8. The magnetic securing device assembly 10 is separated into a first magnetic element 20*a* and a second magnetic element 20*b*. The first magnetic element 20*a* is slid along the cord 16 to a predetermined position above the breast 8 on a first side of the garment 14. The second magnetic element 20*b* is slid along the cord 16 to a predetermined position above the breast 8 on a second side of the garment 16, opposite to the position of the first magnetic element 20*a*. The first and second magnetic elements 20*a*, 20*b* are aligned with each other, and then the first and second magnetic elements 20*a*, 20*b* secure the garment 14 in place by magnetically fastening the first magnetic element 20*a* to the second magnetic element 20*b*.

Employing an "over and under" technique, the method would include the following steps. The peripheral end of the adjustable cord 16 would be tucked under the bottom edge 14*b* of the garment 14, and then upward under the backside of the garment 14 toward the neckline 14*a* of the garment 14 to a position above the breast 8 so that the tethered hook 6 holds the bottom edge 14*b* of the garment 14 above the breast 8, as shown in FIG. 70.

The first magnetic element 20*a* would then be slid along the cord 16 to the predetermined position above the breast 8 and on the first side of the garment 14 where the first side is the front of the garment 14. The second magnetic element 20*b* would then be slid along the cord 16 to the predetermined position above the breast 8, and on the second side of, where the second side of the garment 14 is the rear side of the garment 14 closest to the body of the garment 14. As mentioned above, the first and second magnetic elements 20*a*, 20*b* would then be aligned with each other, and magnetically fastened to each other to secure the garment in place over the breast 8.

By employing an "under and over" technique, the method would include the following steps. The peripheral end of the adjustable cord 16 would be tucked back through the neckline 14*a* behind the garment 14 to the bottom edge 14*b* of the garment 14. The peripheral end of the adjustable cord 16 would then be pulled forward and upward along the front side of the garment 14 toward the neckline 14*a* of the garment 14 to a position above the breast 8 so that the adjustable cord 16 forms a tethered hook 6 that holds the bottom edge 14*b* of the garment 14 above the breast 8.

The first magnetic element 20*a* is then slid along the adjustable cord 16 to the predetermined position above the breast 8 such that the first side of the garment 14 is the front of the garment 14. Likewise, the second magnetic element 20*b* would be slid along the cord 16 to the predetermined position above the breast 8 such that the second side of the garment 14 is the rear side of the garment 14. The first and second magnetic elements 20*a*, 20*b* would then be aligned with each other, and magnetically fastened to each other to secure the garment in place over the breast 8.

Although one exemplary adjustable illustration is shown in these images, it is to be understood that a variety of different adjustment mechanisms may be integrated into the necklace 12 in order to allow the cord 16 to be adjusted into a variety of different sizes and shapes, such as for a bracelet, an anklet, a belt, and various other items that may be decoratively worn by the user.

Figure 72:
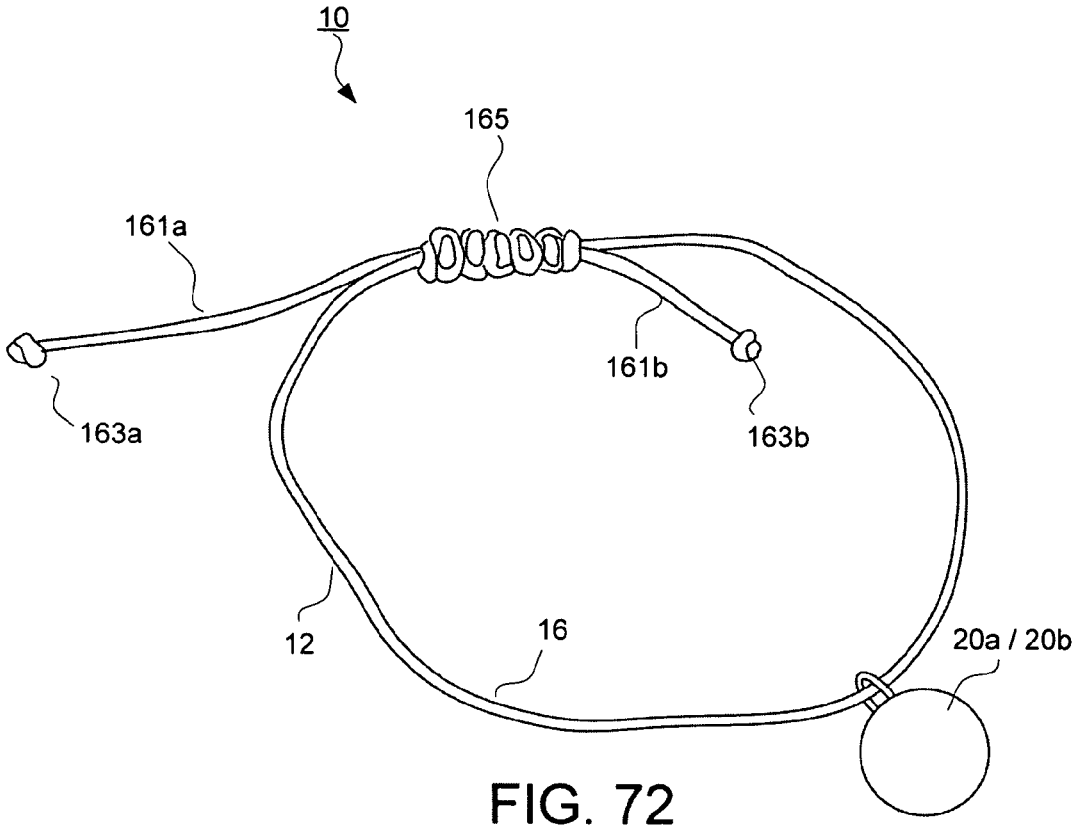
FIG. 72 illustrates another exemplary fastener for the necklace or bracelet in which a channel is provided into which the ends of the cord are aligned and slide within to adjust the length of the necklace or bracelet in accordance with the invention.

FIG. 72 further depicts another exemplary adjustment mechanism 161 for the magnetic securing device assembly 10. The adjustment mechanism 161 includes a channel 165 into which the first end 161*a* and the second end 161*b* of the cord 16 are disposed. In use, the first end 161*a* and the second end 161*b* of the cord 16 are allowed to slide within the channel 165 to a predetermined position so that the internal ring of a necklace 12 or bracelet 216 a can be adjusted to a desired length. In this case, the knots 163*a*, 163*b* are used to prevent the first end 161*a* and the second end 161*b* of the cord 16 from slipping out from within the channel 165.

The channel 165 and cord 16 may be composed of a variety of different suitable materials to provide a predetermined amount or resistance to interact between the cord 16 and the channel 165 so that a suitable degree of resistance will prevent the first end 161*a* and the second end 161*b* from easily slipping within the channel 165 and to maintain a firm connection.

It is to be understood that the magnetic securing device 10 may have a variety of different uses, including but not limited to being used as a fastener. In one such use, the magnetic securing device may be used with drapery. That is, the magnetic securing device may be used to secure drapes back away from a window in a decorative and/or functional manner.

It will be recognized by those skilled in the art that changes or modifications may be made to the above described embodiments without departing from the broad inventive concepts of the invention. It is understood therefore that the invention is not limited to the particular embodiments which are described, but is intended to cover all modifications and changes within the scope and spirit of the invention.

What is claimed is:

1. A magnetic securing device assembly worn as an accessory that secures a garment away from a breast or torso area, comprising:

a first magnetic element completely encased below an outer surface of a faceplate of a first housing of the magnetic securing assembly;

a second magnetic element completely encased below an outer surface of a rear faceplate of a second housing of the magnetic securing assembly that is magnetically attracted to the first magnetic element; and an adjustable cord permanently attached at a first end to the first magnetic element and at a second end to the second magnetic element, where in a first position, the first magnetic element is separated from the second magnetic element, the first magnetic element is positioned around the garment in a first direction, and in alignment with the position of the second magnetic element positioned on an opposite side of the garment, the adjustable cord being resized to a predetermined length to accommodate a mother or a user's hands, magnetically fastening the first magnetic element disposed below the outer surface of the faceplate and the second magnetic element disposed below the outer surface of the rear faceplate directly to each other to permit the garment to be securely held away at a distance determined by the resized adjustment of the adjustable cord from the breast to expose the breast or torso area freeing the mother or the user's hands, and wherein a second position, the first magnetic element is separated from the second magnetic element, the first magnetic element is positioned around the wrist in a first direction, and in magnetic alignment with the position of the second magnetic element positioned around the wrist in a second direction, and the adjustable cord is resized to a second predetermined length to accommodate the wrist size of the mother or user.

2. The magnetic securing device assembly as recited in claim 1, wherein the adjustable cord can be extended or contracted to a desired length between the first position and the second position.

3. The magnetic securing device assembly as recited in claim 2, wherein the length of the adjustable cord can be extended or contracted to a desired length employing an adjustable mechanism including at least one of: a slip-knot, and a channel into which the length of cord may be resized.

4. The magnetic securing device assembly as recited in claim 1, wherein:

the first end of the cord is attached to a first retaining loop, which is attached to the first magnetic element, the second end of the cord is attached to a second retaining loop, which is attached to the second magnetic element, and the first magnetic element and the second magnetic element are magnetically coupled to meet at a mating junction.

5. The magnetic securing device assembly as recited in claim 1, wherein at least one of the first magnetic element and the second magnetic element may be selected from at least one of: a magnet, and a magnetically attractive material.

6. The magnetic securing device assembly as recited in claim 1, wherein the ornamental piece of jewelry is constructed as one of: a necklace; and a bracelet.

7. A bracelet, comprising:

a first magnetic element completely encased below an outer surface of a first recess within a faceplate of a first housing of a magnetic securing assembly;

a second magnetic element completely encased below an outer surface of a second recess within a rear faceplate of a second housing of the magnetic securing assembly that is magnetically attracted to the first magnetic element; and an adjustable cord having a first cord portion permanently attached adjacent to the first magnetic element, and a second cord portion permanently attached adjacent to the second magnetic element, wherein a length of the adjustable cord is extended or contracted between a first desired length and a second desired length, and wherein the first magnetic element and the first cord portion extends along one side of a garment, and the second magnetic element and the second cord portion extend along an opposite side of the garment, the first desired length of the adjustable cord supporting the garment at a predetermined height, the first magnetic element disposed below the outer surface of the faceplate and the second magnetic element disposed below the outer surface of the rear faceplate are aligned and magnetically coupled directly to each other to securely hold the garment at the first desired length of the adjustable cord away from a breast or torso area to expose the area, and wherein a second position, the first magnetic element is positioned around the wrist in a first direction in magnetic alignment with the position of the second magnetic element positioned around the wrist in a second direction, and the adjustable cord is resized to the second desired length to accommodate the wrist size of the mother or user as a bracelet.

8. The bracelet as recited in claim 7, wherein:

the first cord portion is attached to a first retaining loop, which is attached to the first magnetic element, and the second cord portion is attached to a second retaining loop, which is attached to the second magnetic element.

9. The bracelet as recited in claim 7, wherein at least one of the first magnetic element and the second magnetic element may be selected from at least one of: a magnet, and a magnetically attractive material.

10. An adjustable bracelet having a magnetic fastener, comprising:

a first magnetic element completely disposed within a first recess below an outer surface of a faceplate of a first housing of the magnetic fastener;

a second magnetic element completely disposed within a second recess below an outer surface of a rear faceplate of a second housing of the magnetic fastener, the second magnetic element magnetically aligned and attracted to the first magnetic element; and an adjustable cord having a first cord portion permanently attached adjacent to the first magnetic element, and a second cord portion permanently attached adjacent to the second magnetic element, wherein a length of the adjustable cord is extendable to a first desired length to securely hold a garment at a particular height away from a breast or torso area of a person, and contractable to a second desired length to fit around the wrist of a user as a bracelet, the first magnetic element disposed below the outer surface of the faceplate and second magnetic elements disposed below the outer surface of the rear faceplate are aligned and magnetically fastened directly to each other to securely hold a lower end of the garment away from the breast or torso area and free the user's hands.

11. The adjustable bracelet as recited in claim 10, wherein at least one of the first magnetic element and the second magnetic element may be selected from at least one of: a magnet, and a magnetically attractive material.

* * * * *